US006298322B1

(12) United States Patent
Lindemann

(10) Patent No.: US 6,298,322 B1
(45) Date of Patent: Oct. 2, 2001

(54) ENCODING AND SYNTHESIS OF TONAL AUDIO SIGNALS USING DOMINANT SINUSOIDS AND A VECTOR-QUANTIZED RESIDUAL TONAL SIGNAL

(75) Inventor: Eric Lindemann, 2975 18th St., Boulder, CO (US) 80304

(73) Assignee: Eric Lindemann, Boulder, CO (US)

( * ) Notice: Subject to any disclaimer, the term of this patent is extended or adjusted under 35 U.S.C. 154(b) by 0 days.

(21) Appl. No.: 09/306,256

(22) Filed: May 6, 1999

(51) Int. Cl.[7] ..... G10L 19/02

(52) U.S. Cl. ..... 704/222; 704/200.1; 704/209; 704/220

(58) Field of Search ..... 704/200.1, 206, 704/207, 209, 220, 222

(56) References Cited

U.S. PATENT DOCUMENTS

| | | |
|---|---|---|
| 3,816,664 | 6/1974 | Koch . |
| 4,348,929 | 9/1982 | Gallitzendorfer . |
| 4,461,199 | 7/1984 | Hiyoshi . |
| 4,611,522 | 9/1986 | Hideo . |
| 4,856,068 | 8/1989 | Quatieri, Jr. . |
| 4,885,790 | 12/1989 | McAulay . |
| 4,937,873 | 6/1990 | McAulay . |
| 5,029,509 | 7/1991 | Serra . |

FOREIGN PATENT DOCUMENTS

| | | |
|---|---|---|
| 0363233 A1 | 4/1990 | (EP) . |
| 0363233 B1 | 11/1994 | (EP) . |
| 0813184 A1 | 12/1997 | (EP) . |

OTHER PUBLICATIONS

Scott Levine et al., A Switched Parametric & Transform Audio Coder, Proceedings of the IEEE ICASSP, May 15–19, 1999, Phoenix Arizona, Section 2—System Overview.

Jean LaRoche, HNS: Speech Modification Based on a Harmonic + Noise Model Proceedings of IEEE ICASSP, Apr. 1993, Minneapolis, Minnesota, vol. II, p. 550–553 Section 2—Description of the Model.

*Primary Examiner*—Tālivaldis Ivars Šmits

(57) ABSTRACT

Tonal audio signals can be modeled as a sum of sinusoids with time-varying frequencies, amplitudes, and phases. An efficient encoder and synthesizer of tonal audio signals is disclosed. The encoder determines time-varying frequencies, amplitudes, and, optionally, phases for a restricted number of dominant sinusoid components of the tonal audio signal to form a dominant sinusoid parameter sequence. These components are removed from the tonal audio signal to form a residual tonal signal. The residual tonal signal is encoded using a residual tonal signal encoder (RTSE). In one embodiment, the RTSE generates a vector quantization codebook (VQC) and residual codebook sequence (RCS). The VQC may contain time-domain residual waveforms selected from the residual tonal signal, synthetic time-domain residual waveforms with magnitude spectra related to the residual tonal signal, magnitude spectrum encoding vectors, or a combination of time-domain waveforms and magnitude spectrum encoding vectors. The tonal audio signal synthesizer uses a sinusoidal oscillator bank to synthesize a set of dominant sinusoid components from the dominant sinusoid parameter sequence generated during encoding. In one embodiment, a residual tonal signal is synthesized using a VQC and RCS generated by the RTSE during encoding. If the VQC includes time-domain waveforms, an interpolating residual waveform oscillator may be used to synthesize the residual tonal signal. The synthesized dominant sinusoids and synthesized residual tonal signal are summed to form the synthesized tonal audio signal.

42 Claims, 26 Drawing Sheets

U.S. PATENT DOCUMENTS

| | | | | |
|---|---|---|---|---|
| 5,195,166 | | 3/1993 | Hardwick . | |
| 5,226,108 | | 7/1993 | Hardwick . | |
| 5,327,518 | | 7/1994 | George . | |
| 5,369,730 | | 11/1994 | Yajima . | |
| 5,401,897 | | 3/1995 | Depalle . | |
| 5,479,564 | | 12/1995 | Vogten . | |
| 5,581,656 | | 12/1996 | Hardwick . | |
| 5,686,683 | | 11/1997 | Freed . | |
| 5,717,821 | * | 2/1998 | Tsutsui et al. | 704/200.1 |
| 5,744,742 | | 4/1998 | Lindemann . | |
| 5,765,126 | * | 6/1998 | Tsutsui et al. | 704/200.1 |
| 5,774,837 | | 6/1998 | Yeldener . | |
| 5,787,387 | | 7/1998 | Aguilar . | |
| 5,806,024 | | 9/1998 | Ozawa . | |
| 5,848,387 | * | 12/1998 | Nishiguchi et al. | 704/214 |

* cited by examiner

ENCODING AND SYNTHESIS OF TONAL AUDIO SIGNALS USING DOMINANT SINUSOIDS AND A VECTOR-QUANTIZED RESIDUAL TONAL SIGNAL

FIELD OF THE INVENTION

This invention relates to encoding and synthesizing tonal audio signals, especially voiced speech and music signals.

BACKGROUND OF THE INVENTION

Tonal sounds can be effectively modeled as a sum of sinusoids with time-varying parameters consisting of frequency, amplitude, and phase. The key word here is "effectively" because, in fact, all sounds can be modeled as sums of sinusoids, but the number of sinusoids may be extremely large, and the time-varying sinusoidal parameters may not have intuitive significance. Colored noise signals like breath noise, ocean waves, and snare drums are examples of sounds that are not effectively modeled by sums of sinusoids. Pitched musical instruments such as clarinet, trumpet, gongs, and certain cymbals, as well as ensembles of these instruments are examples of tonal sounds that are effectively modeled as sums of sinusoids.

Many sounds are modeled as a combination of tonal and non-tonal, or colored noise, sounds. Flute and violin both have tonal and colored noise components. Human speech is often modeled as a mixture of tonal or "voiced" speech, and colored noise or "unvoiced" speech. The present invention is concerned with encoding and synthesizing tonal audio signals. This invention can be used in conjunction with systems for encoding and synthesizing non-tonal or colored noise signals.

Pitched signals are a special class of tonal audio signals in which the sinusoidal frequencies are harmonically related. The present invention can be used for encoding and synthesizing both pitched and unpitched tonal audio signals. Specifically optimized embodiments are proposed for encoding and synthesizing pitched tonal audio signals.

In this specification we use the term "tonal audio signal" to refer to all audio signals that can be effectively modeled as a sum of sinusoids with time-varying parameters consisting of frequency, amplitude, and phase. These are all signals that are not noise-like in character. We use the term "pitched tonal audio signal" or simply "pitched signal" to refer to tonal audio signals whose sinusoidal frequencies are harmonically related. The term "voiced signal" is a common term of art that refers to the pitched tonal audio signal component of a speech signal. The term "unvoiced signal" is a term of art that refers to the noise-like component of a speech signal. This is the non-tonal part of the signal that cannot be effectively modeled as a sum of sinusoids with time-varying parameters consisting of frequency, amplitude, and phase.

One method of encoding and synthesizing tonal audio signals is additive sinusoidal encoding and synthesis. This method provides excellent results since the encoding and synthesis model is the same model as the signal: a sum of sinusoids with time-varying parameters. U.S. Pat. Nos. 4,885,790 and 4,937,873, both to McCauley et. al, and U.S. Pat. No. 4,856,068, to Quatieri, J R. et al., teach systems for encoding and synthesizing sound waveforms as a sums of sinusoids with time-varying amplitude, frequency, and phase. While sinusoidal encoding and synthesis provides excellent results for tonal audio signals, the synthesis requires large computational resources because many tonal audio signals may involve one hundred or more individual sinusoids.

To reduce the computational requirement of sinusoidal synthesis U.S. Pat. Nos. 5,401,897 to Depalle et al., 5,686,683, to Freed, and 5,327,518 teach systems for sinusoidal synthesis using Inverse Fast Fourier Transform (IFFT) techniques. While this approach reduces somewhat the computation requirements for synthesis of a large number of parameters, the computation is still expensive and new problems are introduced. Many synthesis environments, for example musical synthesizers, require multi-channel output. Using IFFT approaches, a separate IFFT system must be used for every channel. In addition, IFFT systems limit sinusoidal parameter update to once per frame, where a frame_length must be at least as long as the lowest frequency period. This parameter update rate may be insufficient at higher frequencies.

U.S. Pat. Nos. 5,581,656, 5,195,166, and 5,226,108, all to Hardwick et al., teach a system where a certain number of sinusoids, the dominant or low-frequency sinusoids, are synthesized using traditional time-domain sinusoidal additive synthesis, while the remaining sinusoids are synthesized using an IFFT approach. This permits higher update rate for the dominant sinusoid components while taking advantage of the lower IFFT computation rate for the bulk of the sinusoids. This approach has the disadvantages of IFFT computation cost especially with multi-channel synthesis. In addition, the dominant sinusoid components are usually at lower frequencies and it is the higher that often require an increased parameter update rate.

A number of less compute-intensive systems have been proposed for encoding and synthesizing tonal audio signals. Linear Predictive Coding (LPC) is well known in the art of speech coding and synthesis. Methods for using LPC for synthesizing tonal or voiced speech concentrate on methods for generating the tonal excitation signal. The numerous approaches include, generating a pulse-train at the desired pitch, generating a multi-pulse excitation signal at the desired pitch, vector quantizing (VQ) the excitation signal, and simply transmitting the excitation signal with fewer bits. U.S. Pat. No. 5,744,742, to Lindemann et al., teaches a system for encoding excitation signals as single pitch period loops. To synthesize excitation signals at different pitches or amplitudes, weighted sums of pitch period excitation signal loops are created. The excitation signal pitch periods are stored in single pitch period waveform memory tables. The phase response of all excitation signal waveforms is forced to be the same so that weighted sums of the waveforms do not cause phase cancellation. All of these techniques with the exception of simply transmitting the excitation signal give poorer results than full additive sinusoidal encoding and synthesis. The pulse based techniques in particular sound "buzzy" and unnatural.

U.S. Pat. Nos. 5,369,730 to Yajima, 5,479,564 to Vogten et al., European Patent 813,184 A1 to Dutoit et al., European Patents 0,363,233A1 and 0,363,233B1, both to Hamon, teach methods of pitch synchronous concatenated waveform encoding and synthesis. With this method a number of single pitch period waveforms are stored in memory. To synthesize a time-varying signal, a sequence of single pitch period waveforms is selected from waveform memory and concatenated over time. The waveform are usually overlap-added for continuity. To shift the pitch of the synthesized signal the overlap rate is modulated. While relatively inexpensive in terms of compute resources, this approach suffers from distortions especially associated with the pitch shifting mechanism. Is audibly inferior to full additive synthesis for most tonal audio signals.

In the music synthesizer field, an approach similar concatenated waveform synthesis is referred to as waveform sequencing. With waveform sequencing each single pitch period waveform is pitch shifted using sample rate conversion techniques and looped for a specified time to generate a stable magnitude spectrum. To generate time-varying magnitude spectra the waveforms are generally cross-faded over time. U.S. Pat. Nos. 3,816,664, to Koch, 4,348,929, to Gallitzendorfer, 4,461,199 and Reissue 34,913, to Hiyoshi et al., and U.S. Pat. No. 4,611,522 to Hideo teach systems of waveform sequencing relative to music synthesis. Waveform sequencing can be economical in computation resources but much of the complex time-varying character of the magnitude spectra is lost due to reduction to a limited number of waveforms.

A number of hybrid systems have been proposed that use additive sinusoidal encoding and synthesis for one part of a signal—usually the tonal part—and some other technique for the another part of the signal—usually the colored noise part. U.S. Pat. No. 5,029,509 to Serra et al. teaches a system for full sinusoidal encoding and synthesis of the tonal part of a signal and LPC coding of the non-tonal part of the signal. This approach has the computational expense of full sinusoidal additive encoding and synthesis plus the expense of LPC coding and synthesis. A similar approach is applied to speech signals in U.S. Pat. Nos. 5,774,837, to Yeldener et al., and U.S. Pat. No. 5,787,387 to Aquilar.

In "A Switched Parametric & Transform Audio Coder", Scott Levine et al., Proceedings of the IEEE ICASSP, May 15–19, 1999 Phoenix, Ariz., a system is taught wherein low frequencies are encoded and synthesized using full sinusoidal additive synthesis, and high frequencies are encoded using LPC with a white noise excitation signal. This is economical in terms of computation, but the high-frequency synthesized signal sounds excessively noise-like for tonal audio signals. A similar approach is applied to voiced speech signals in "HNS: Speech Modification Based on a Harmonic+Noise Model," J. Laroche et al., Proceedings of IEEE ICASSP, April 1993, Minneapolis, Minn. The use of colored noise to model the high frequencies of tonal audio signals is less objectionable when applied to speech signals, but still results in some "buzzyness" at high frequencies.

U.S. Pat. No. 5,806,024, to Ozawa, teaches a system wherein the short time magnitude spectrum of the tonal audio signal is determined in frames. The tonal audio signal is assumed to have a harmonic component with time-varying pitch. The pitch varies slowly enough that it can be considered constant over each frame. For each frame, a pitch is determined. A harmonic spectrum is determined for each frame as the values of the magnitude spectrum at multiples of the pitch frequency. A residual spectrum is determined for each frame as the magnitude spectrum minus the harmonic spectrum. The harmonic spectrum frames and residual spectrum frames are vector quantized (VQ) to form a harmonic spectrum codebook, residual spectrum codebook, and a gain codebook. The signal is encoded as sequence of unique coding vector numbers identifying coding vectors in these codebooks. Thus the harmonic spectrum codebook sequence codes the pitched part of the signal, and the residual codebook sequence codes the non-tonal and non-pitched-but-tonal part of the signal. This approach can be economical but with VQ, much of the richness in time-varying behavior is lost. This is especially true for complex tonal audio signals such as high-fidelity music signals.

BRIEF SUMMARY OF THE INVENTION

Accordingly, one object of the present invention is to synthesize tonal sounds, especially voiced speech or musical sound, of high quality equivalent to full sinusoidal additive synthesis or IFFT sinusoidal synthesis, but with fewer encoding parameters and greatly reduced computational requirements.

Another object of the present invention is to synthesize tonal sounds without the artificial "buzzyness" associated with pulse-based LPC techniques.

Another object of the present invention is to synthesize high quality tonal sounds without audible loss of complex time-varying behavior associated with harmonic VQ or waveform sequencing techniques.

Another object of the present invention is to synthesize high-quality natural sounding pitch shifted sounds without the distortions associated with pitch synchronous concatenated waveform synthesis.

Another object of the present invention is to permit a rapid parameter update rate for components of the signal that require it.

The present invention assumes a tonal audio signal that can be represented as a sum of sinusoids of time-varying frequency, amplitude, and phase. A hybrid synthesis approach is used, in which a limited number of the most dominant sinusoid components are synthesized using full time-domain sinusoidal additive synthesis. The remaining sinusoids are synthesized using a less optimal synthesis method.

In encoding, the time-varying frequencies, amplitudes, and phases of the dominant sinusoid components are determined. These form a dominant sinusoid parameter sequence that encodes the dominant part of the tonal audio signal. Then the dominant sinusoid components are removed from the tonal audio signal. The remaining residual tonal signal is still assumed to be a sum of sinusoids. A number of embodiments are described for encoding this residual. Two embodiments involve generating a residual waveform codebook. The residual waveform codebook consists of a number of time-domain waveform segments. The magnitude spectra of these waveform segments is designed using vector quantization coding techniques (VQ) to be representative of the various magnitude spectra appearing in the residual tonal signal. A sequence of these waveforms is concatenated or overlap-added to synthesize an approximation of the original residual tonal signal.

In another embodiment, the residual tonal signal is encoded using linear predictive coding (LPC). The residual excitation signal of the linear prediction is then encoded using either a residual excitation codebook method, multipulse coding, or simply encoded as a pulse train with appropriate time-varying energy. The LPC filter coefficients may be further encoded using a vector quantization codebook (VQ).

For many natural tonal sounds, the largest amplitude sinusoids appear at low frequencies. The frequency resolution of human hearing is also most sensitive at low frequencies. Therefore, several embodiments Of the present invention separate dominant sinusoid components from residual tonal signal sinusoids by splitting the tonal audio signal into low and high-frequency bands. The low-frequency band in encoded and resynthesized with full sinusoidal encoding and synthesis. The high-frequency band is encoded using a less accurate residual tonal signal encoding and synthesis method.

In all embodiments of the present invention the residual tonal signal is encoded and synthesized using a method involving fewer time-varying parameters than full sinusoidal synthesis. This reduces the encoding bit-rate and for the embodiments described, reduces the computation requirements for synthesis of the residual tonal signal relative to full sinusoidal additive synthesis. These methods are collectively referred to in this specification as residual tonal signal encoder and synthesis methods.

Many tonal sounds of interest are pitched. These can be represented as a sum of harmonically related sinusoids. Several of the embodiments of the present invention take advantage of this property in the encoding of both dominant sinusoid components and residual tonal signal.

During synthesis, the dominant sinusoid components are synthesized using a bank of time-domain sinusoidal oscillators and the residual tonal signal is synthesized using a residual tonal signal synthesis method. The resynthesized signal is a sum of the low-frequency synthesized sinusoids and the resynthesized residual tonal.

Since the dominant sinusoid components are synthesized using full sinusoidal synthesis, the dominant part of the signal has excellent quality. The residual tonal signal is much lower in power than the dominant part of the signal. It can therefore be encoded and synthesized using a residual tonal signal encoder and synthesizer of lesser quality. The distortions and loss of time-varying complexity associated with the residual tonal signal encoder and synthesizer are disguised or masked by the high quality of the dominant part of the synthesized signal.

Thus, the present invention relies on psycho-acoustic masking properties to motivate a hybrid approach to tonal audio signal encoding and synthesis. The approach achieves extremely high quality and naturalness with modest computational requirements and an efficient parametric representation. The approach excels in preserving the complex time-varying behavior of high-fidelity music signals.

DETAILED DESCRIPTION OF THE INVENTION

Figure 1:
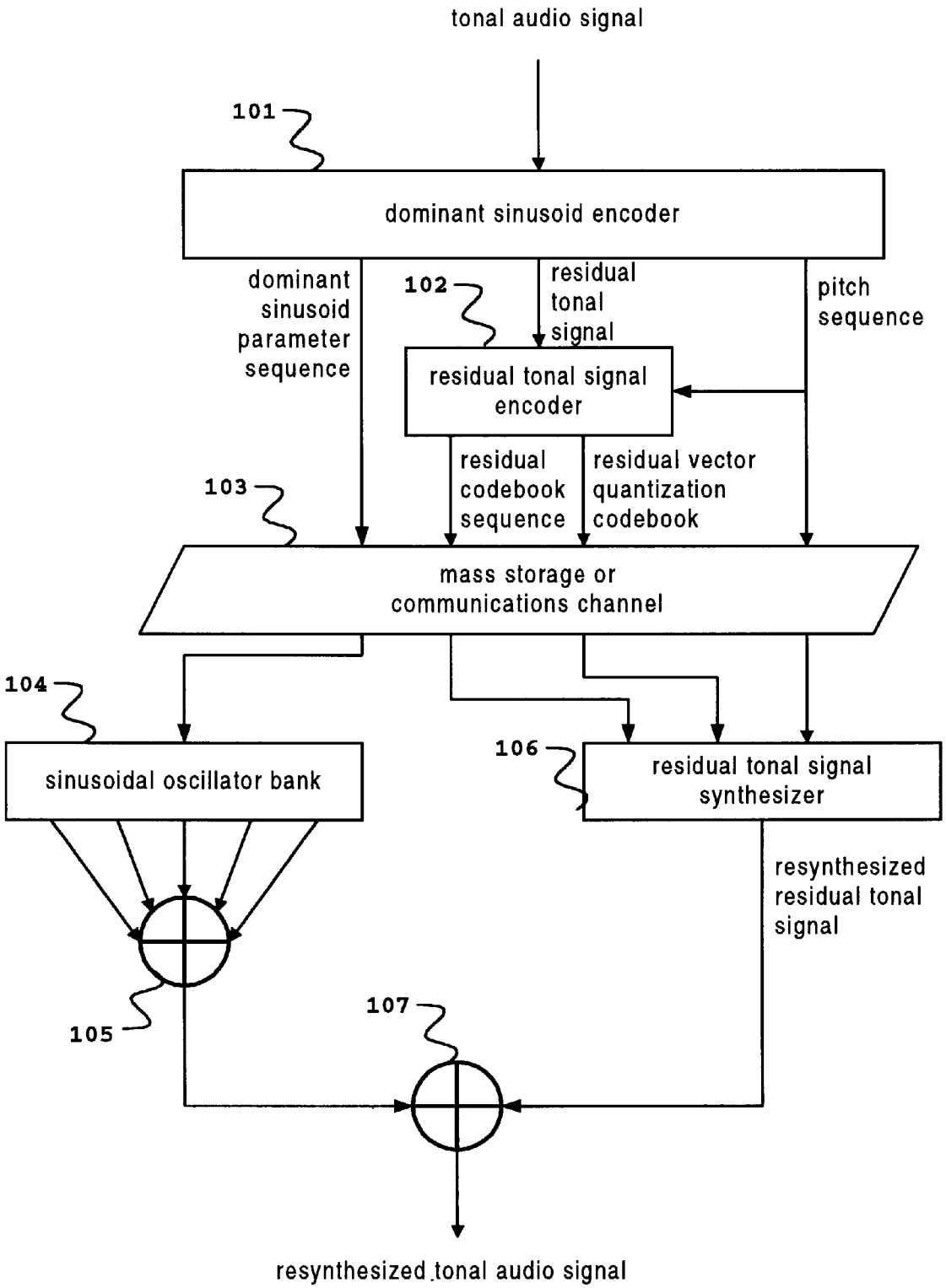
FIG. 1 shows a high-level block diagram of the encoder and synthesizer according to the present invention.

The present invention includes an audio signal encoder and an audio signal synthesizer of audio and speech signals. FIG. 1 shows a block diagram of the present invention. Blocks 101,102 comprise the encoder. The encoded tonal audio signal is sent to block 103 for storage or transmission over a communications channels. Blocks 104,105,106,107 comprise the synthesizer.

The audio signal is assumed to be a sum of sinusoids with time-varying frequencies, amplitudes, and phases. The sinusoidal frequencies may, or may not, be harmonically related. This type of audio signal will be referred to as a tonal audio signal. The tonal audio signal enters the dominant sinusoid encoder 101. In 101, the dominant sinusoid components—those with the largest amplitude—are identified. The number of dominant sinusoid components is predefined and limited to a small number—typically 4 to 10. The time-varying frequencies, amplitudes, and optionally phase of the dominant sinusoid components are determined in 101. These form the dominant sinusoid parameter sequence, which is sent to 103. In 101, a pitch sequence, identifying the time-varying pitch of the tonal audio signal, is also generated. In 101, a residual tonal signal is also computed. The residual tonal signal is the tonal audio signal with the dominant sinusoid components removed.

The residual tonal signal is sent to the residual tonal signal encoder 102, which encodes the residual tonal signal and generates the residual codebook sequence and residual vector quantization codebook. The residual codebook sequence, residual vector quantization codebook, and pitch sequence are sent to the mass storage or communications channel 103.

During synthesis, the dominant sinusoid parameter sequence is input to sinusoidal oscillator bank 104. The outputs of the oscillator hank are summed in adder 105 to form the resynthesized dominant sinusoid signal. The residual codebook sequences residual vector quantization codebook, and pitch sequence are input to residual tonal signal synthesizer 106. The output of residual tonal signal synthesizer 106 is the resynthesized residual tonal signal. The resynthesized dominant sinusoid signal and resynthesized residual tonal signal are summed, 107, to form the final resynthesized output.

Figure 2:
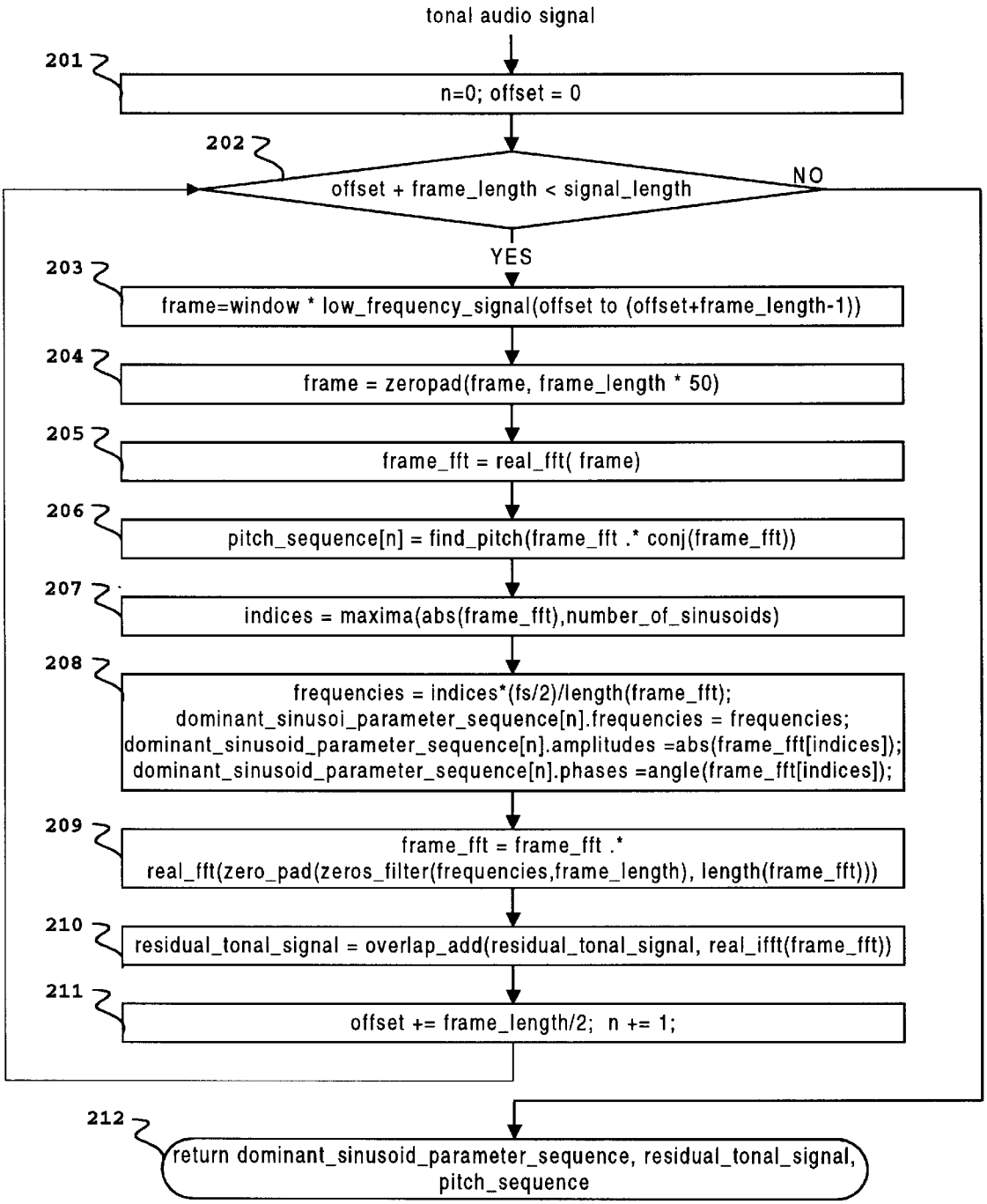
FIG. 2 shows a flow diagram of one embodiment of the dominant sinusoid encoder, in which sinusoidal frequencies are identified as the maxima of the magnitude spectrum, and the residual tonal signal is generated by zero-filtering in the frequency domain.

FIG. 2 shows a flow diagram of one embodiment of the dominant sinusoid encoder corresponding to 101 of FIG. 1. In 201, the variables n and offset are initialized to zero. In 202, a test is made to see if there are another frame_length samples beginning at offset in the tonal audio signal. This frame_length block of samples forms a new frame. If a new frame is available, then blocks 203 to 211 calculate a pitch sequence value and dominant sinusoid parameter sequence values for the new frame. In 203, the frame is multiplied by a tapered window function. In 204, the windowed frame is zero-padded by a large factor—50 times frame_length in the embodiment of FIG. 2. The large zero-padding allows higher resolution frequency estimates. In 205, the FFT of the windowed and zero-padded frame is taken. In 206, the pitch of the frame is found by calling the function find_pitch on the magnitude squared of the frame FFT.

Figure 18:
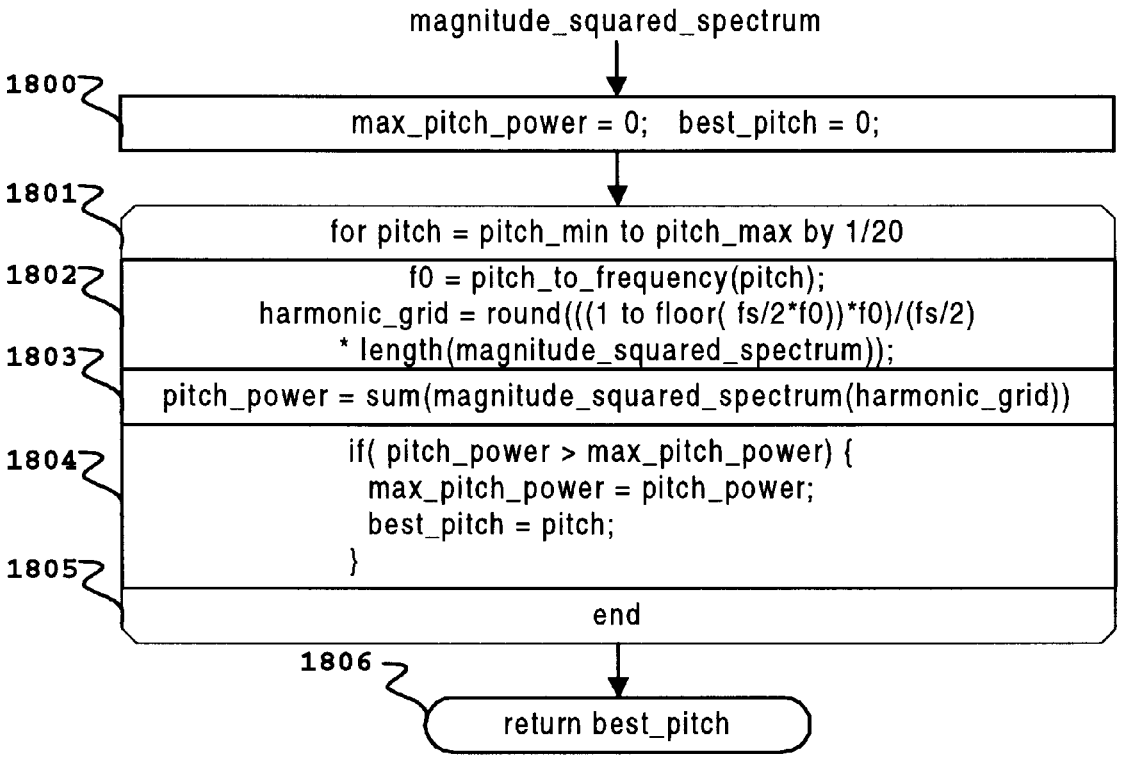
FIG. 18 shows a flow diagram of the find_pitch function used in the dominant sinusoid encoder embodiments of FIG. 2 through FIG. 5.

FIG. 18 shows a flow diagram of one embodiment of the find_pitch function of the present invention. In 1800, maximum pitch power and best pitch are initialized to zero in preparation for the loop that begins at 1801. The loop scans the candidate pitches, for the current frame, from pitch_min to pitch_max in increments of 1/20 of a half-step.

The pitch value is in the form of a MIDI pitch value where integer 69=A440, and every integer step is a musical half step—e.g. 70=B flat above A440 and 68=G# below A440. Fractional pitch values are permitted in the pitch sequence.

In 1902, every candidate pitch is first converted to fundamental frequency f0 by a call to the function pitch_to_frequency. Then a harmonic_grid is constructed. The harmonic_grid is an array of indices of FFT bins. The FFT bin indices are chosen so that their center frequencies are closest to an array of harmonically related frequencies beginning at the fundamental frequency f0 and continuing with 2*f0, 3*f0, etc. up to half the sample rate of the tonal audio signal. In 1803, the harmonic_grid indices are used to select magnitude squared bins from magnitude squared FFT. The sum of the values in these bins is computed to form pitch power. This is a measure of the power of the spectrum at harmonics of f0. The candidate pitch with the greatest pitch power will be taken as the pitch estimate for the current frame. In 1804, if the candidate pitch power is greater than the current maximum pitch power, then maximum pitch power is set equal to the candidate pitch power and best pitch is set equal to the candidate pitch. Then the loop continues testing the next candidate pitch until all candidates have been tested. After the loop end in 1805, the best pitch is returned in 1806.

Those skilled in the art of pitch encoder design will understand that many techniques can be used to estimate time-varying pitch. These techniques include searching for peaks in auto-correlation or cepstral functions. The character of the present invention does not depend on the specific technique used to estimate time-varying pitch.

In 207 of FIG. 2, the bin indices of the largest maxima of the magnitude spectrum are found. Number of sinusoids is the number of largest maxima to find—e.g. 4. A maximum is defined as a bin[n] whose values satisfy bin[n−1]<bin[n] <=bin[n+1]. The equal condition is extremely rare for natural sounds. These bin indices correspond to the dominant sinusoid components. In 208 the dominant sinusoid parameter sequence frequencies, amplitudes, and phases are set as a function of the values in the complex spectrum bins pointed to by the bin indices.

In 209, the complex spectrum is multiplied by a zeros-filter frequency-domain vector, with zeros at the locations of the dominant sinusoid components. This zeros-filter is generated by transforming the time-domain impulse response of a FIR filter generated by placing zeros on the unit circle of the Z plane at locations corresponding to the dominant sinusoid frequencies, and converting these zeros to FIR filter coefficients. The result of multiplying the complex spectrum by the zeros-filter is to substantially remove the dominant sinusoid components from the complex spectrum. In 210, the remaining residual complex spectrum is inverse transformed and overlap-added with the tail of the current residual tonal signal. In 211, offset and n are incremented. The variable n gives the frame count of the encoding loop.

Flow of control passes back to 202. If there are another frame_length samples in the tonal audio signal, then a new set of dominant sinusoid parameters and a new pitch sequence value for the next frame are computed. If not, flow of control passes to 212. The dominant sinusoid parameter sequence, residual tonal signal, and pitch sequence are returned and the dominant sinusoid encoder terminates.

Figure 3:
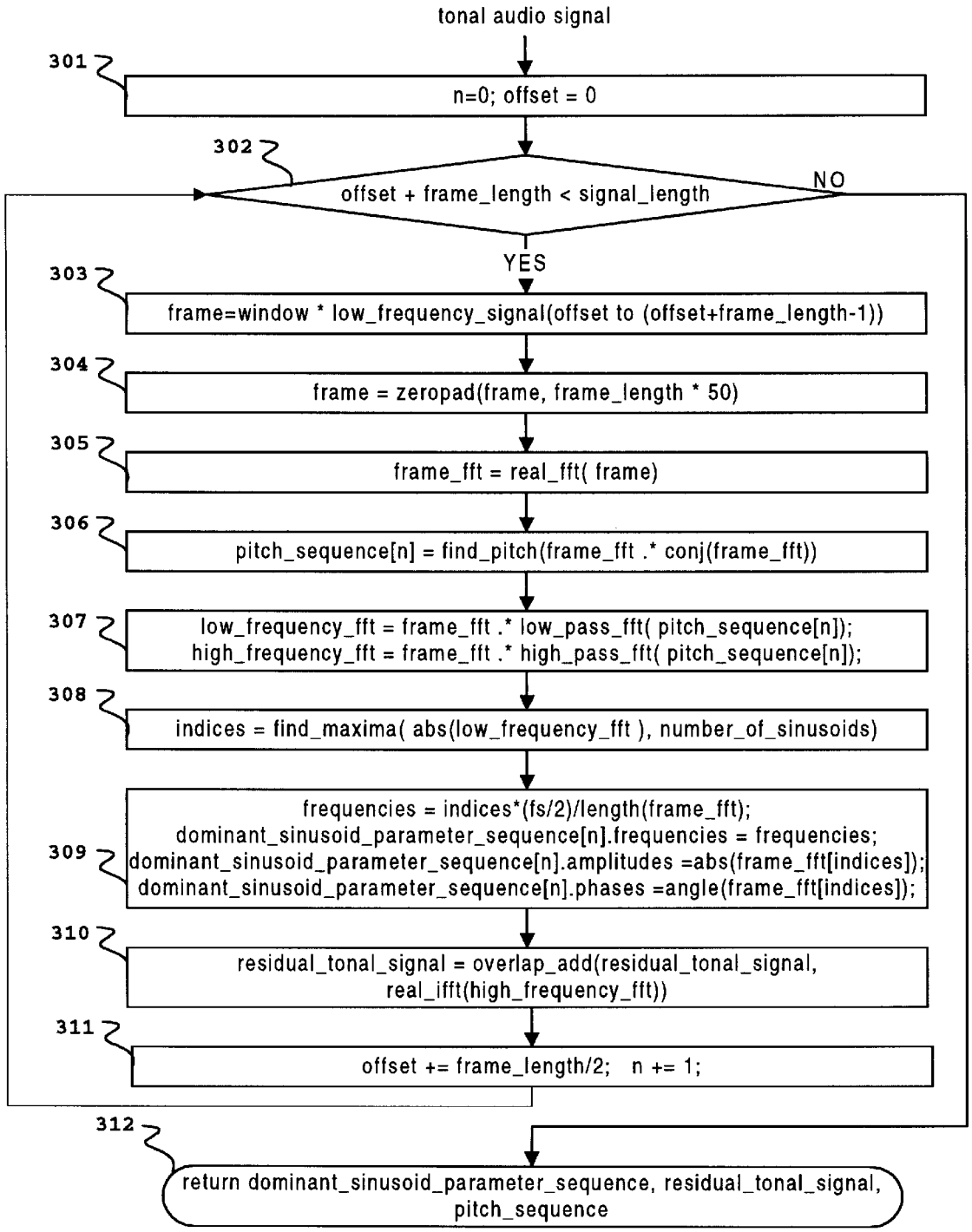
FIG. 3 shows a flow diagram of one embodiment of the dominant sinusoid encoder, in which sinusoidal frequencies are identified as the maxima of the low-frequency magnitude spectrum, and the residual tonal signal is generated by high-pass filtering the tonal audio signal in the frequency domain.

FIG. 3 shows the flow diagram of another embodiment of the dominant sinusoid encoder according to the present invention. The embodiment of FIG. 3 is largely similar to that of FIG. 2. Differences begin with block 307. In 307, the frame FFT vector is multiplied by two frequency domain filter vectors, a highpass filter vector, and a symmetrical mirror image lowpass filter vector. The sum of the two filter vectors is unity across all frequencies. The cross-over frequency between the two filter vectors is determined as a function of the pitch sequence value just computed in 306. The result of the multiplication is the low-frequency FFT and high-frequency FFT complex spectrum vectors. In 308, the indices of the maxima of only the low-frequency FFT vector are found. In 309, these indices are used, as in FIG. 2, to set the dominant sinusoid parameter sequence values.

In 310, the residual tonal signal is generated by inverse transforming the high-frequency FFT vector only. No zero-filters are generated. It is simply assumed that the dominant sinusoid components are all at low harmonics. This assumption is valid for many natural sounds, especially musical instrument sounds. The remainder of the loop is identical to FIG. 2.

Figure 4:
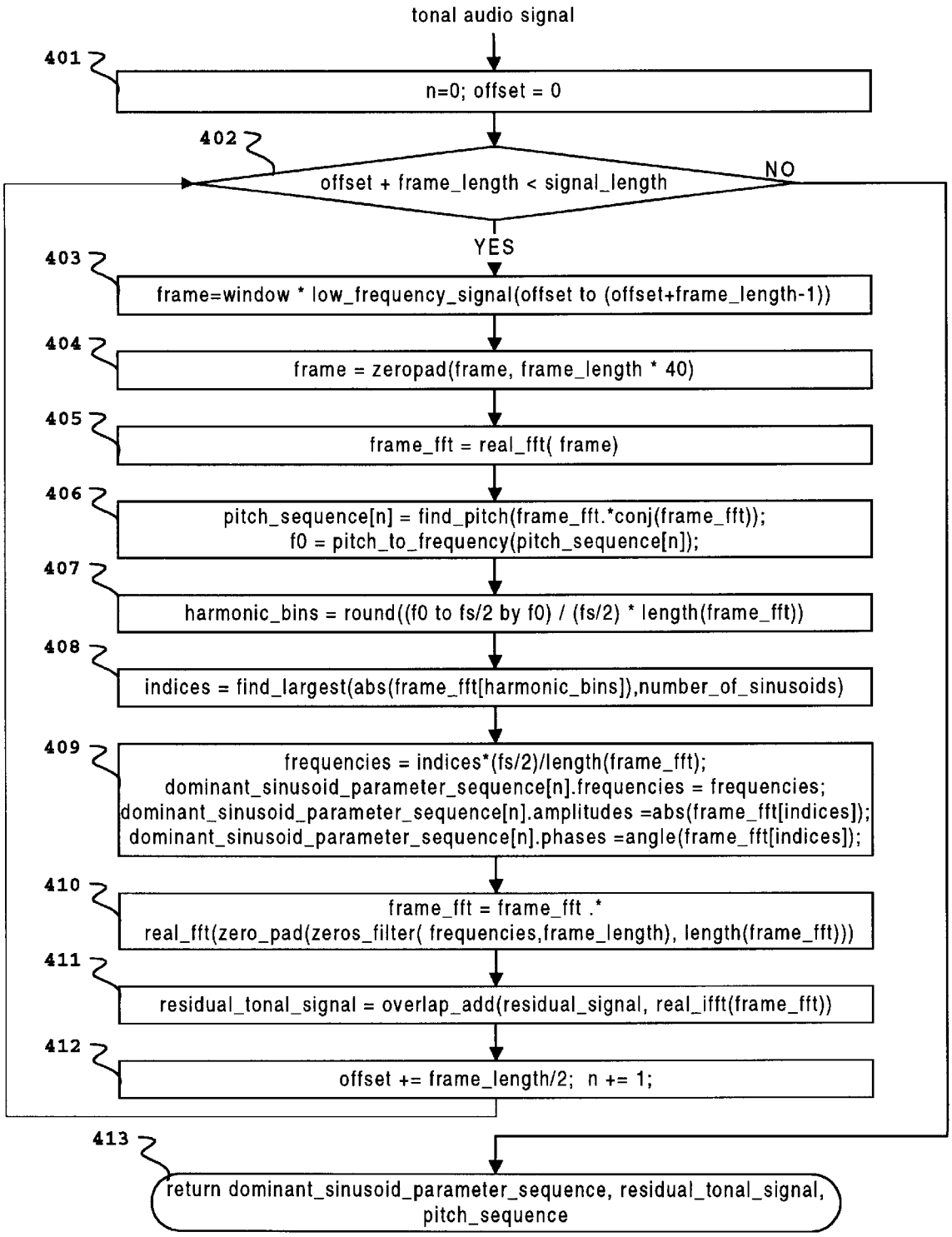
FIG. 4 shows a flow diagram of one embodiment of the dominant sinusoid encoder, in which sinusoidal frequencies are identified as selected harmonics of a fundamental frequency, and the residual tonal signal is generated by zero-filtering in the frequency domain.

FIG. 4 shows the flow diagram of another embodiment of the dominant sinusoid encoder according to the present invention. Like FIG. 3, the embodiment of FIG. 4 is largely similar to that of FIG. 2. Differences begin in block 406. In 406, in addition to computing the pitch sequence value, the value is converted to fundamental frequency f0. In 407, harmonic bins is set to those FFT bins whose center frequencies are closest to integer multiples of f0. In 408, the indices of the harmonic bins with the largest magnitude are found. In 409, these indices are used to set the dominant sinusoid parameter sequence values for the current frame. The remainder of the loop is identical to FIG. 2, with the residual tonal signal being generated by using a zeros-filter.

Figure 5:
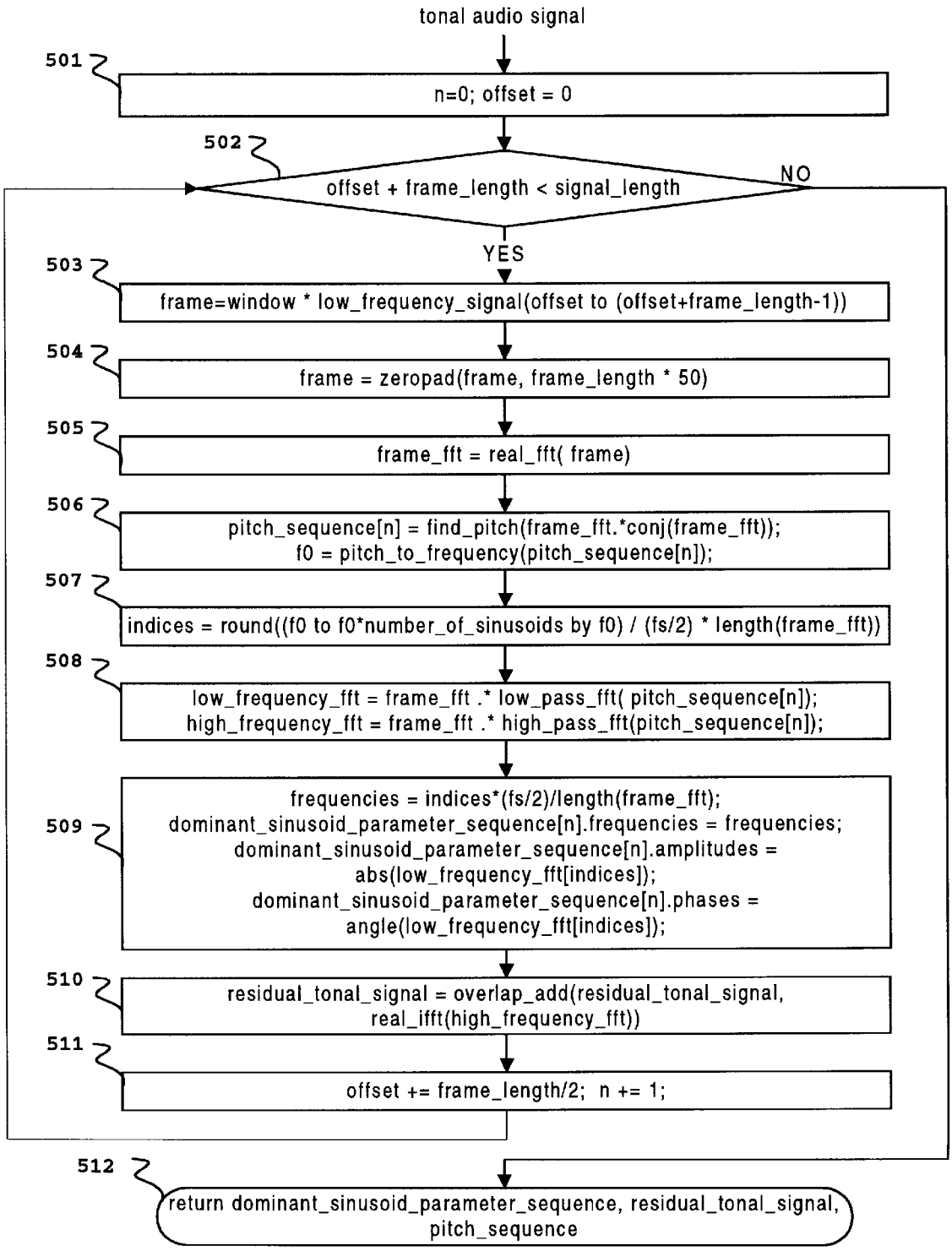
FIG. 5 shows a flow diagram of one embodiment of the dominant sinusoid encoder, in which sinusoidal frequencies are identified as selected low-frequency harmonics of a fundamental frequency, and the residual tonal signal is generated by high-pass filtering the tonal audio signal in the frequency domain.

FIG. 5 shows the flow diagram of yet another embodiment of the dominant sinusoid encoder according to the present invention. Like FIG. 3 and FIG. 4, the embodiment of FIG. 5 is largely similar to that of FIG. 2. Differences begin in block 506. In 506, the pitch value is converted to fundamental frequency f0, just as in FIG. 4. In 507, the indices of the dominant sinusoid components are set to the first few integer multiples of f0. That is, in FIG. 5, the tonal audio signal waveform is assumed to be harmonic, and the dominant sinusoid components are assumed to be the first few lowest frequency harmonics of the tonal audio signal.

In 508, the FFT vector is split into low-frequency and high-frequency vectors, just as in FIG. 3. In 509, the indices are used to set the dominant sinusoid parameter sequence values. In 510, the high-frequency FFT band is used to generate the residual tonal signal as in FIG. 3. The remainder of the loop is identical to FIG. 2.

Regardless of the specific embodiment of the dominant sinusoid encoder, the dominant sinusoid parameter sequence output is sent to mass storage or communications channel 103 of FIG. 1. The residual tonal signal output is sent to the residual tonal signal encoder 102 of FIG. 1. The pitch sequence output is sent to the residual tonal signal encoder 102 for specific embodiments of the residual tonal signal encoder that require it. These will be detailed below. In addition, only the embodiments of FIG. 3, FIG. 4, FIG. 5 of the dominant sinusoid encoder make internal use of the pitch sequence values. In the event that the embodiment of FIG. 2 is used in combination with an embodiment of the residual tonal signal encoder that does not require a pitch sequence input, the pitch sequence generation in FIG. 2 block 206 may be omitted completely.

For the embodiment of FIG. 4, the pitch sequence completely defines the dominant sinusoid frequencies. In this case, only the pitch sequence and the amplitudes and phases of the dominant sinusoid parameter sequence need be sent to 103 of FIG. 1. For the embodiment of FIG. 4, the frequencies may be expressed as multiples of the pitch sequence values.

In another embodiment, no phases are included in the dominant sinusoid parameter sequence. Instead, an arbitrary phase is generated during synthesis with a guarantee that the phase is continually updated over time.

The techniques described above for removing the dominant sinusoid components from the tonal audio signal to form the residual tonal signal involve creating a frequency domain zeros-filter and multiplying the magnitude spectrum or complex spectrum by this frequency domain zeros-filter. In another embodiment, the windowed tonal audio signal frame is filtered using a time-domain zeros-filter. The time-domain zeros-filter is generated by inverse transforming of the frequency-domain zeros-filter or by a number of direct zeros-filter design techniques that are well known to those skilled in the art of digital filter design.

In yet another embodiment of the dominant sinusoid encoder, the dominant sinusoid components are removed from the tonal audio signal to generate the residual tonal signal by resynthesizing the dominant sinusoid components from the time-varying amplitudes, frequencies, and phases and subtracting the resynthesized dominant sinusoid components from the tonal audio signal to generate the residual tonal signal.

Many techniques for dominant sinusoid parameter estimation are known to those skilled in the art of digital signal processing. In addition to the embodiments described above, these techniques include modeling the time-domain waveform segment associated with each frame as the impulse response of an all-pole or pole-zero filter. Sinusoidal frequencies are determined by phase angle of the pole position. Sinusoidal amplitudes and phases are determined by evaluating the Fourier transform of the impulse at the sinusoidal frequencies. The specific dominant sinusoid parameter estimation technique used does not affect the character of the present invention. The requirement is that the time-varying frequencies, amplitudes, and optionally phases of the dominant sinusoid components be identified and that the dominant sinusoid components be removed from the tonal audio signal to generate the tonal residual signal.

Figure 25:
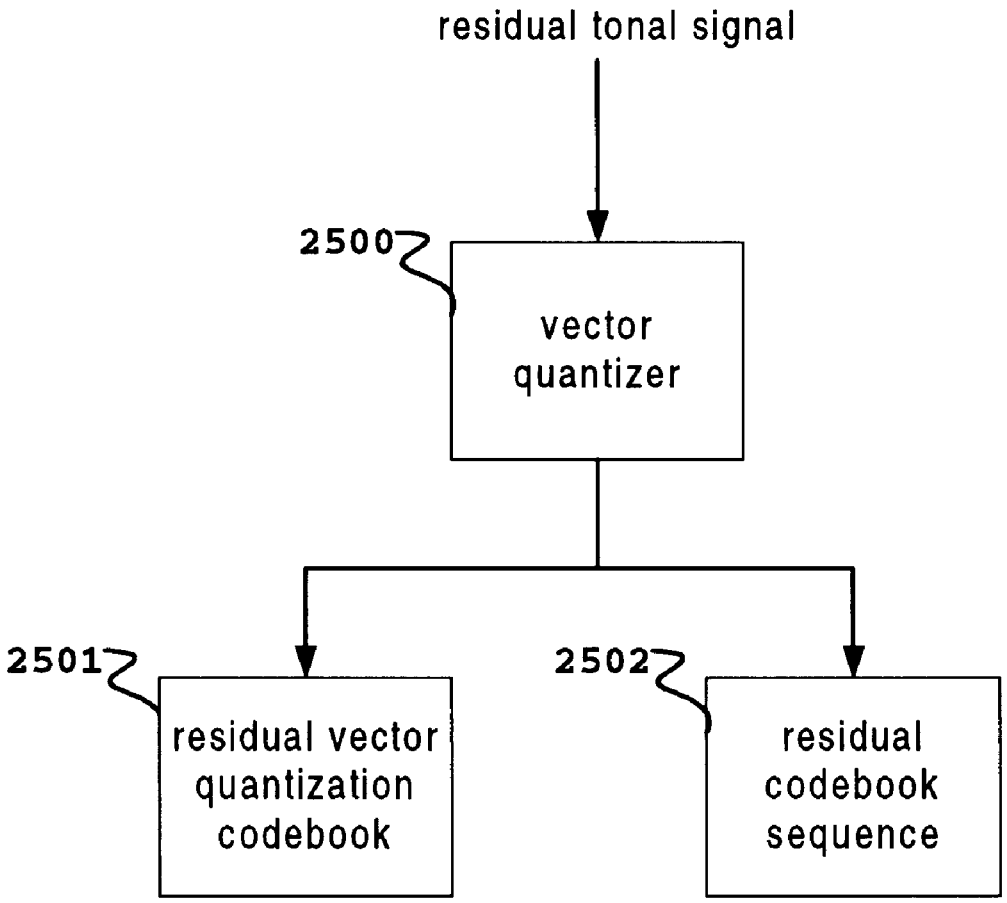
FIG. 25 shows a high-level block diagram of the residual tonal signal encoder based on vector quantization, according to the present invention.

FIG. 25 shows a block diagram of the residual tonal signal encoder 102 of FIG. 1. The residual tonal signal is vector quantized, 2500, to produce a residual vector quantization codebook, 2501, and a residual codebook sequence, 2502. To produce the residual vector quantization codebook the residual tonal signal is segmented into frames, and the frames are grouped into clusters of similar frames. The residual vector quantization codebook, 2501, contains codebook vectors that represent these clusters. Each codebook vector in the residual vector quantization codebook, 2501, is associated with a unique codebook number. The number can simply be the starting address of the vector in the codebook or the index number of the vector in the array of codebook vectors. The residual codebook sequence, 2502, is a sequence of these unique codebook numbers, and as such defines a sequence of codebook vectors. This sequence, together with the residual vector quantization codebook, is the encoded residual tonal signal that is sent to 103 of FIG. 1.

Figure 26:
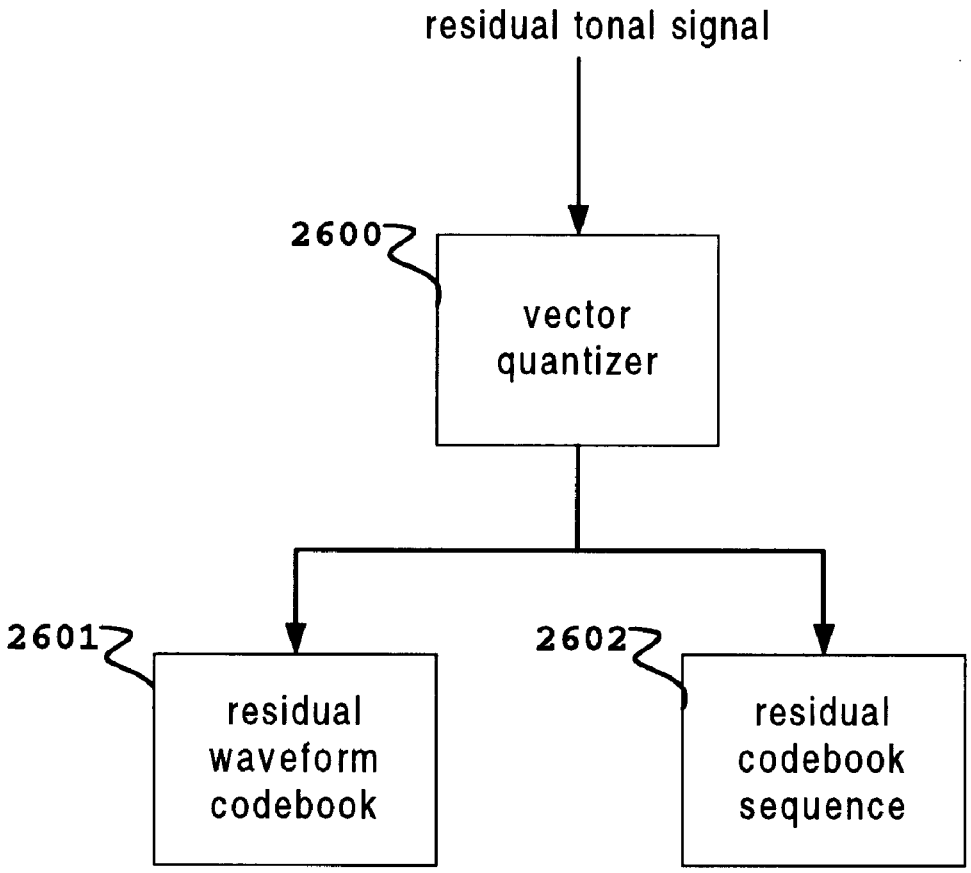
FIG. 26 shows a high-level block diagram of the residual tonal signal encoder based on vector quantization to produce a residual waveform codebook.

FIG. 26 shows one embodiment of the residual tonal signal encoder according to the present invention. In the embodiment of FIG. 26 the residual vector quantization codebook takes the form of a residual waveform codebook, 2601. The residual codebook sequence then specifies a sequence of waveforms. When this sequence of waveforms is arranged in order they approximate the original residual tonal signal.

We will describe several embodiments of the residual tonal signal encoder. Each embodiment includes a number of data objects stored in memory and a number of operations that manipulate these data objects.

Figure 6:
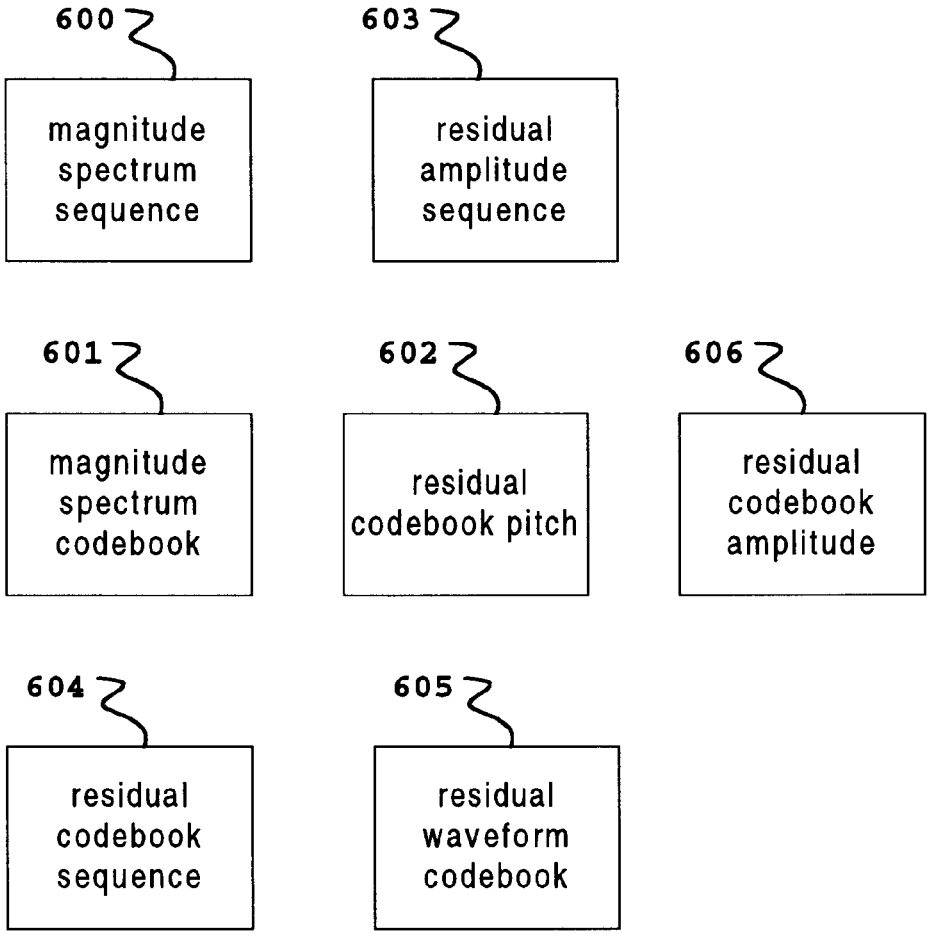
FIG. 6 shows data objects associated with one embodiment of the residual tonal signal encoder using vector quantization based on the time-varying magnitude spectrum of the residual tonal signal.

FIG. 6 shows a block diagram of the data objects of one embodiment of the residual tonal signal encoder. The magnitude spectrum sequence, 600, is a table containing a time sequence of magnitude spectrum estimates for overlapping sample frames of the residual tonal audio signal.

Figure 7:
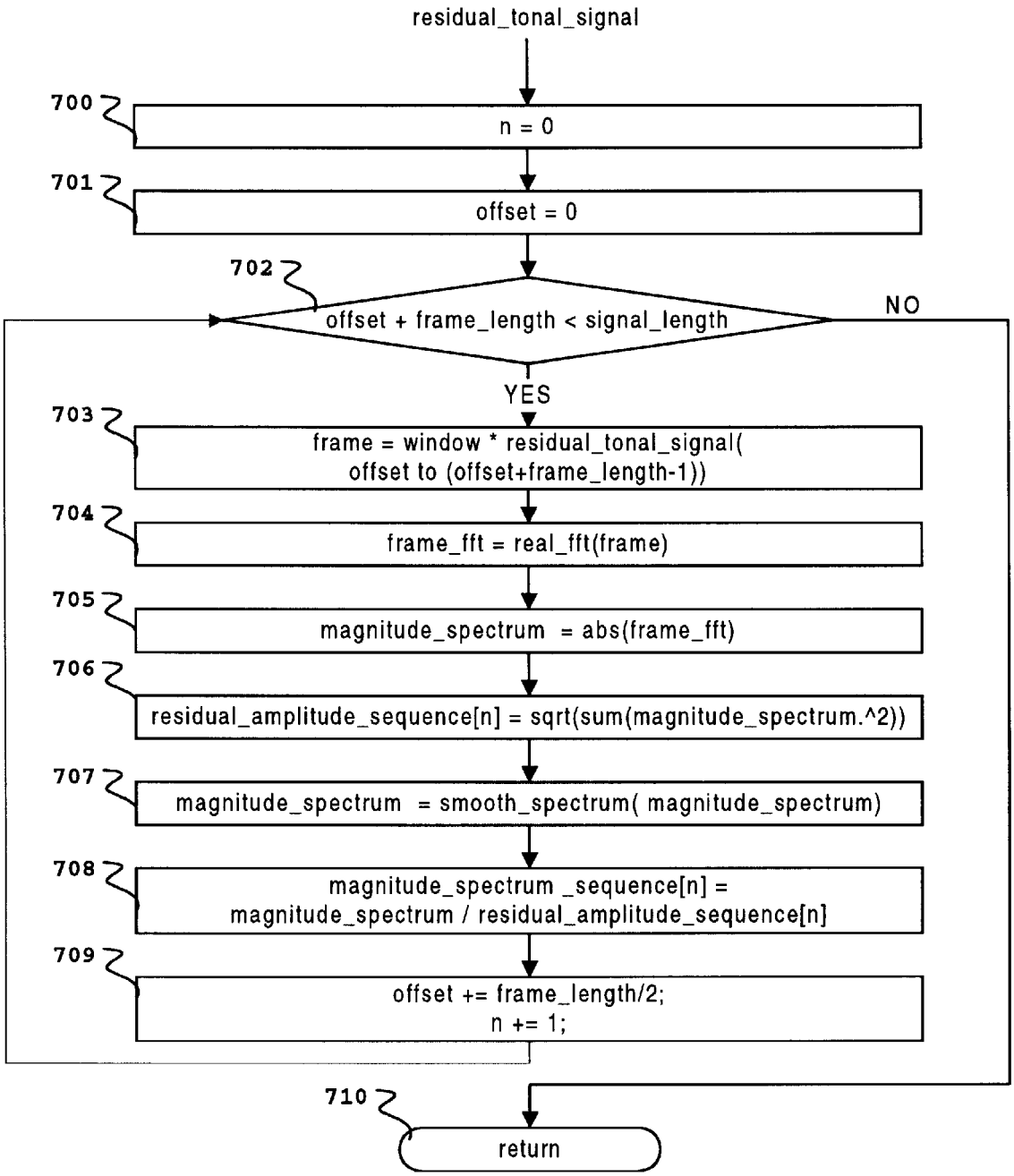
FIG. 7 shows a flow diagram of the generation of the magnitude spectrum sequence of FIG. 6.

FIG. 7 shows a flow diagram of the operation that fills the magnitude spectrum sequence, 600 of FIG. 6. The flow diagram begins much like the dominant sinusoid encoder of FIG. 2. In 700 and 701 the variables n and offset are initialized to zero. In 702, a test is made to see if there is another frame_length samples beginning at offset in the tonal audio signal. If so, then blocks 703 to 708 calculate the magnitude spectrum of the frame and store it in the magnitude spectrum sequence. In 703, the frame is multiplied by a tapered window function. In 704, the FFT of the windowed frame is taken, and in 705, the magnitude spectrum is computed. In 706, the square root of the sum over all frequencies of the magnitude spectrum squared is taken and stored as the next value in the residual amplitude sequence 603 of FIG. 6.

The residual tonal signal is assumed to be a sum of sinusoids. Therefore, the magnitude spectrum is assumed to contain a number of peaks corresponding to sinusoids. These may, or may not, be harmonically related. Later we will see that the residual tonal signal encoder computes distances between different magnitude spectra. These distances are based on the overall smoothed shape of the magnitude spectra, not the details of individual harmonic components. In 707, the smooth_spectrum function is called.

Figure 17:
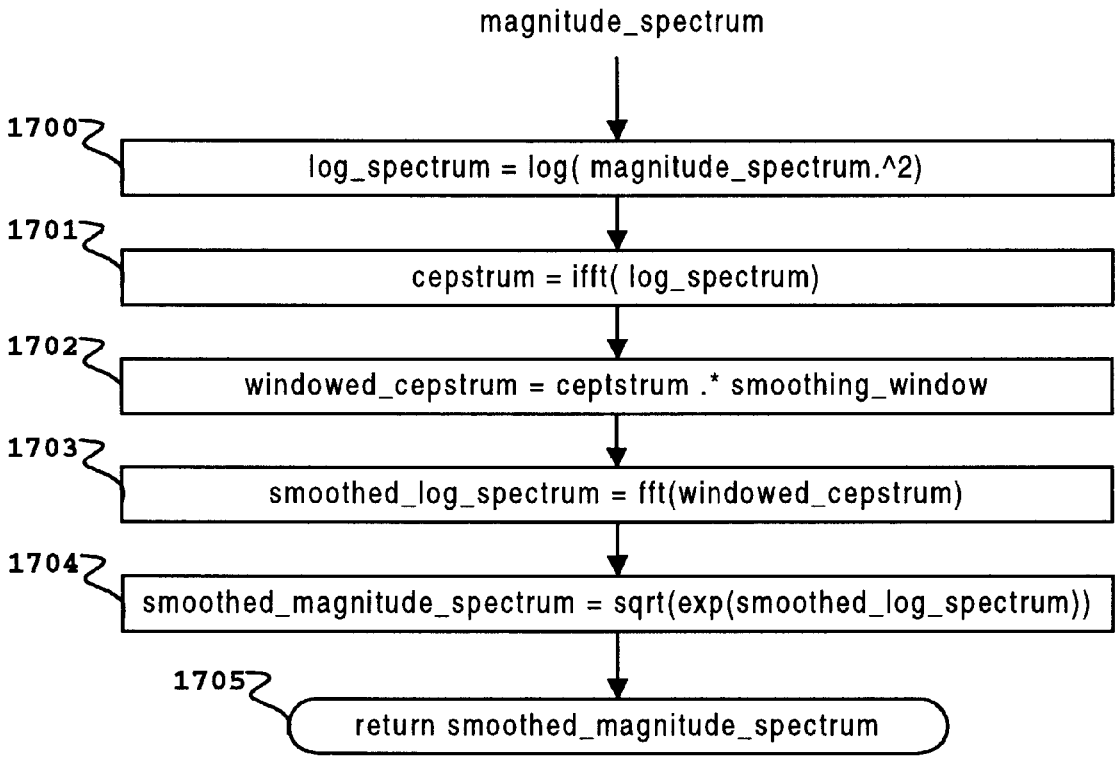
FIG. 17 shows a flow diagram of the smooth_spectrum function used in FIG. 7.

FIG. 17 shows a flow diagram of the smooth_spectrum function. In 1700, the log of the magnitude spectrum squared is taken. In 1701, the inverse Fourier transform of the log spectrum is taken. This forms the cepstrum function. In 1702, the cepstrum function is windowed by a rectangular window that zeros the cepstrum function everywhere except a fairly small region around the center point, or zero time point, of the cepstrum function. In 1703, the Fourier transform of the windowed cepstrum is taken. The result is a smoothed log spectrum. In 1704, the square root of the exponent of the smoothed log spectrum is taken to form the smoothed magnitude spectrum. In 1705, the smoothed magnitude spectrum is returned to block 707 in FIG. 7.

FIG. 17 is known as homomorphic filtering and is well known to those skilled in the art of spectral smoothing. Other well known techniques exist for generating smoothed magnitude spectra from peaky sinusoidal spectra. These include interpolating between the peaks of the magnitude spectrum, LPC spectral estimation, and polynomial fitting of the peaky magnitude spectrum The character of the present invention does not depend on the specific magnitude spectrum smoothing technique used.

In 708, the smoothed magnitude spectrum is normalized by the residual amplitude sequence value for the current frame and is stored as the next magnitude spectrum in the magnitude spectrum sequence, 600 of FIG. 6. In 709, offset and n variables are incremented and control flow returns to 702. If there are another frame_length samples remaining in the residual tonal signal then another magnitude spectrum is calculated and stored in the magnitude spectrum sequence. If not, then the magnitude spectrum sequence calculation operation is complete and returns in 710.

The next operation for the residual tonal signal encoder is to vector quantize (VQ) the magnitude spectrum sequence 600 of FIG. 6, and store the resulting codebook in the magnitude spectrum codebook 601 of FIG. 6. In the process, the residual codebook pitch 602, and residual codebook sequence 604, both of FIG. 6 will also be computed. The VQ coding operation is described in the flow diagram of FIG. 8.

In 800, the variables last total distance and total distance are initialized in preparation for the VQ coding operation. The VQ coding begins, in 801, by filling the magnitude spectrum codebook with magnitude spectra selected at random from the magnitude spectrum sequence. The residual codebook pitch and residual codebook amplitude are filled with the pitch sequence and residual amplitude sequence values associated with the randomly selected magnitude spectrum sequence entries.

The VQ coding loop is an iterative process that attempts to reduce a total distance measure between vectors in the magnitude spectrum sequence and a, much reduced, number of vectors in the magnitude spectrum codebook. In 802, the rate of progress of the VQ coding is determined by computing the difference between the last computed value of total distance (last total distance), which is the sum of all distances, and the new value of total distance. If this difference is not greater than a pre-defined PROGRESS_THRESHOLD then the VQ coding algorithm has converged and the VQ coding operation is exited in 817. If sufficient progress has been made then another iteration is executed to try to continue the progress. The initialization in 800 is guaranteed to result in the calculation of at least one VQ coding iteration.

Blocks 803 through 816 describe one iteration of the VQ coding algorithm. Block 803 begins a loop over all magnitude spectra in the magnitude spectrum codebook. The magnitude spectrum codebook stores a predefined number of magnitude spectra. For each magnitude spectrum in the magnitude spectrum codebook, block 804 begins a loop over all n magnitude spectra in the magnitude spectrum sequence.

In 805, the distance between the currently selected magnitude spectrum codebook entry and the currently selected magnitude spectrum sequence entry is computed and stored in a distance matrix. The distance is computed as the difference between the sum of the squares of the selected magnitude spectrum sequence entry and the squares of the magnitude spectrum codebook entry, and twice the "cross-power" between the two magnitude spectra. Here, "cross-power" refers to the inner-product between the magnitude spectrum sequence and magnitude spectrum codebook spectra. The superscript T in 805 is vector transpose indicating that the multiplication is an inner-product operation. A penalty term based on pitch distance is added to form the final distance value.

When the magnitude spectrum sequence and magnitude spectrum codebook entries are identical then the sum of their magnitudes squared is equal to twice the cross-power and the entire distance is due to the pitch penalty. To the extent that the magnitude spectrum sequence and magnitude spectrum codebook entries differ, the difference between sum of magnitudes squared and twice the cross-power becomes larger.

The pitch based penalty term in 805 is the weighted magnitude of the difference between the pitch associated with the magnitude spectrum codebook entry and the pitch associated with the magnitude spectrum sequence entry. The magnitude of the difference is rounded to an integer, where each integer step represents a fixed number of musical half steps as determined by the value pitch_sz. With pitch_sz==2 every integer step in pitch distance equals 2 musical half-steps. Any unrounded differences less than plus or minus one half step will be rounded to zero pitch difference. Any unrounded differences between plus or minus one half and plus or minus three half steps will be rounded to one, and so on. The rounded pitch differences are weighted by a predefined pitch_weight value. Rounded pitch differences of zero remain at zero no matter the pitch_weight. The result is that pitches with a small distance, within one quantization step as determined by pitch_sz, will not add to the overall distance while pitches greater than this small distance will add an amount dependent on pitch_weight. Pitch_weight is set large enough so that distances with rounded pitch differences greater than zero are always very large compared to distances with zero rounded pitch distance. As a result, when it comes time to cluster the magnitude spectrum sequence entries into groups by distance, the groups will always be divided first by pitch group.

When the nested loop terminates in 807, the distance between every magnitude spectrum codebook entry and every magnitude spectrum sequence entry will have been computed. The distance matrix has dimensions of number of magnitude spectrum codebook entries by the number of magnitude spectrum sequence entries, where the m,n entry in the distance matrix is the distance between the mth magnitude spectrum codebook entry and the nth magnitude spectrum sequence entry.

The residual codebook sequence, 604 of FIG. 6, is equal in length to the magnitude spectrum sequence. Every residual codebook sequence entry is associated with the corresponding entry in the magnitude spectrum sequence. Each entry in the residual codebook sequence is a coding vector number that selects an entry in the magnitude spectrum codebook. This entry has the smallest distance from the corresponding entry in the magnitude spectrum sequence. In the distance matrix, every column corresponds to an entry in the magnitude spectrum sequence and every row corresponds to an entry in the magnitude spectrum codebook. The residual codebook sequence is computed in a loop over all frames, or over all columns of the distance matrix. The loop begins in block 808 of FIG. 8. In 809, the closest_vector function searches the distances from the currently selected magnitude spectrum sequence entry to all of the magnitude spectrum codebook entries and returns the coding vector number of the magnitude spectrum codebook entry that is closest to the magnitude spectrum sequence entry. The coding vector number is just the index of the selected coding vector in the codebook. Thus, on exit from the loop in 810 each magnitude spectrum in the magnitude spectrum sequence is associated with the nearest magnitude spectrum in the magnitude spectrum codebook, via the unique coding vector numbers in the residual codebook sequence.

Figure 8:
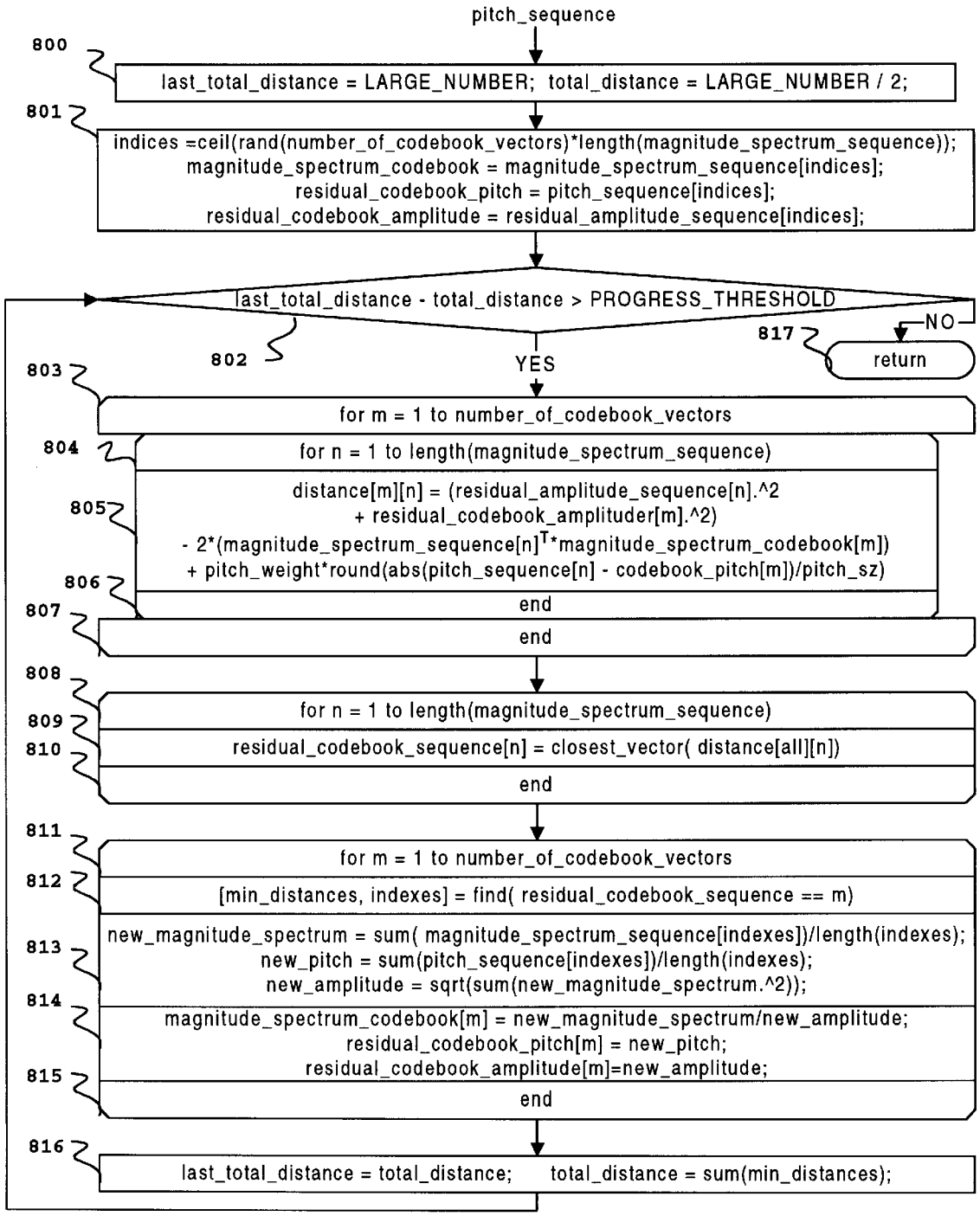
FIG. 8 shows a flow diagram of the generation of the magnitude spectrum codebook and residual codebook sequence of FIG. 6.

The next step, in the VQ coding iteration of FIG. 8, is to update the magnitude spectrum codebook, 601. This is done in the loop beginning with block 811. The loop is over all entries in the magnitude spectrum codebook, 601. In 812, for each magnitude spectrum codebook entry, the residual codebook sequence, 604, is searched to find all unique coding vector numbers associated with the selected magnitude spectrum codebook entry. Then, in 813, all the corresponding entries in the magnitude spectrum sequence are averaged. In 814, this average replaces the entry in the magnitude spectrum codebook. The new magnitude spectrum codebook entry is the centroid of the magnitude spectra in the magnitude spectrum sequence associated with the currently selected magnitude spectrum codebook entry. In addition, in 813, the new residual codebook pitch is calculated as the average, or centroid, of the pitches associated with the selected magnitude spectra in the magnitude spectrum sequence. These pitches are taken from the pitch sequence, whose entries correspond one-to-one with the entries in the magnitude spectrum sequence, 600. The new residual codebook amplitude is the square root of the sum of squares of the new magnitude spectrum codebook entry. In 814, the new averaged pitch and the new residual amplitude replace the current residual codebook pitch, 602, and residual codebook amplitude, 606.

After each magnitude spectrum codebook, residual codebook pitch, and residual codebook amplitude entry has been updated, the loop terminates in 815, and in 816 last total distance is set equal to the current total distance and total distance is recomputed as the sum of the distances between the magnitude spectrum sequence, 600, entries and the associated magnitude spectrum codebook entries, 601, as specified by the residual codebook sequence 604.

Flow of control returns to 802 and if insufficient progress was made in the last iteration the VQ coding operation terminates. Otherwise, another iteration is performed.

The VQ coding operation described in FIG. 8 is known as the Generalized Lloyd algorithm, and is well known to those skilled in the art of vector quantizer design. Many techniques exist for VQ coding. The character of the present invention does not depend on a specific VQ technique. In FIG. 8, a Euclidean distance measure is used. Many distance measures are known to the skilled in the art of VQ coder design. The character of the present invention does not depend on the specific distance measure used.

The key elements in the VQ coder operation are the formation of the magnitude spectrum sequence, the clustering of magnitude spectra in the sequence into groups based on minimizing distance within each group, and the representation of each group by a single magnitude spectrum in the magnitude spectrum codebook.

Figure 9:
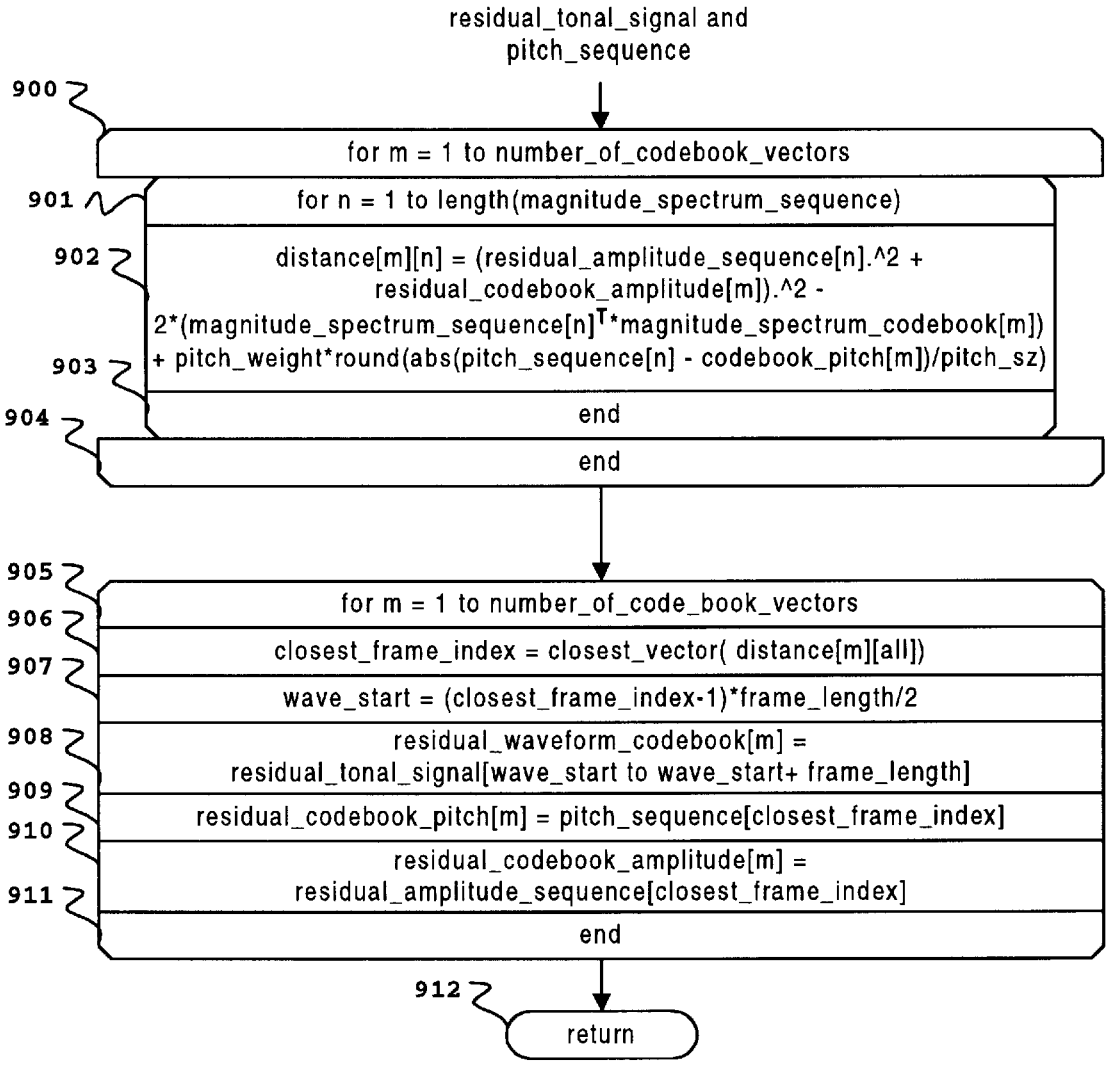
FIG. 9 shows a flow diagram of the generation of the residual waveform codebook, residual codebook pitch, and residual codebook amplitude of FIG. 6.

After the magnitude spectrum codebook has been determined, the next operation for the residual tonal signal encoder is generation of the residual waveform codebook, 605 in FIG. 6. The magnitude spectrum codebook 601 contains a number of magnitude spectra. For each magnitude spectrum in the magnitude spectrum codebook, a time-domain waveform is generated in 605. FIG. 9 shows a flow diagram of the residual waveform codebook generation operation. The operation begins with the recalculation of the distance matrix. This is done in the nested loop of 900 through 904. The calculation is identical with the distance matrix calculation of FIG. 8. The purpose of repeating the calculation is to find the distances relative to the newly updated magnitude spectrum codebook.

The loop beginning in 905 is over all magnitude spectra in the magnitude spectrum codebook, 601. In 906, the new distance matrix is searched to find the index of the magnitude spectrum in the magnitude spectrum sequence, 600, that is closest to the currently selected magnitude spectrum in the magnitude spectrum codebook. The magnitude spectrum found corresponds to a frame_length waveform segment from the tonal audio signal. In 907, the index is used to calculate the start of this waveform segment. In 908, the waveform segment is copied into the residual waveform codebook, 605 of FIG. 6.

To summarize the residual waveform codebook generation operation, for each magnitude spectrum in the magnitude spectrum codebook, the nearest magnitude spectrum in the magnitude spectrum sequence is found. The frame_length waveform segment corresponding to this magnitude spectrum sequence entry is stored in the residual waveform codebook. The residual codebook sequence, 604, can then be considered to contain a sequence of unique waveform numbers where each waveform number selects a waveform in the residual waveform codebook.

The final encoded tonal audio signal consists of the residual waveform codebook, 605, the residual codebook sequence 604, the residual amplitude sequence 603, the dominant sinusoid parameter sequence from 101, and the pitch sequence from 101. Together these are referred to as the "encoded tonal audio signal". The encoded tonal audio signal is sent to the mass storage or communications channel, 103.

Figure 10:
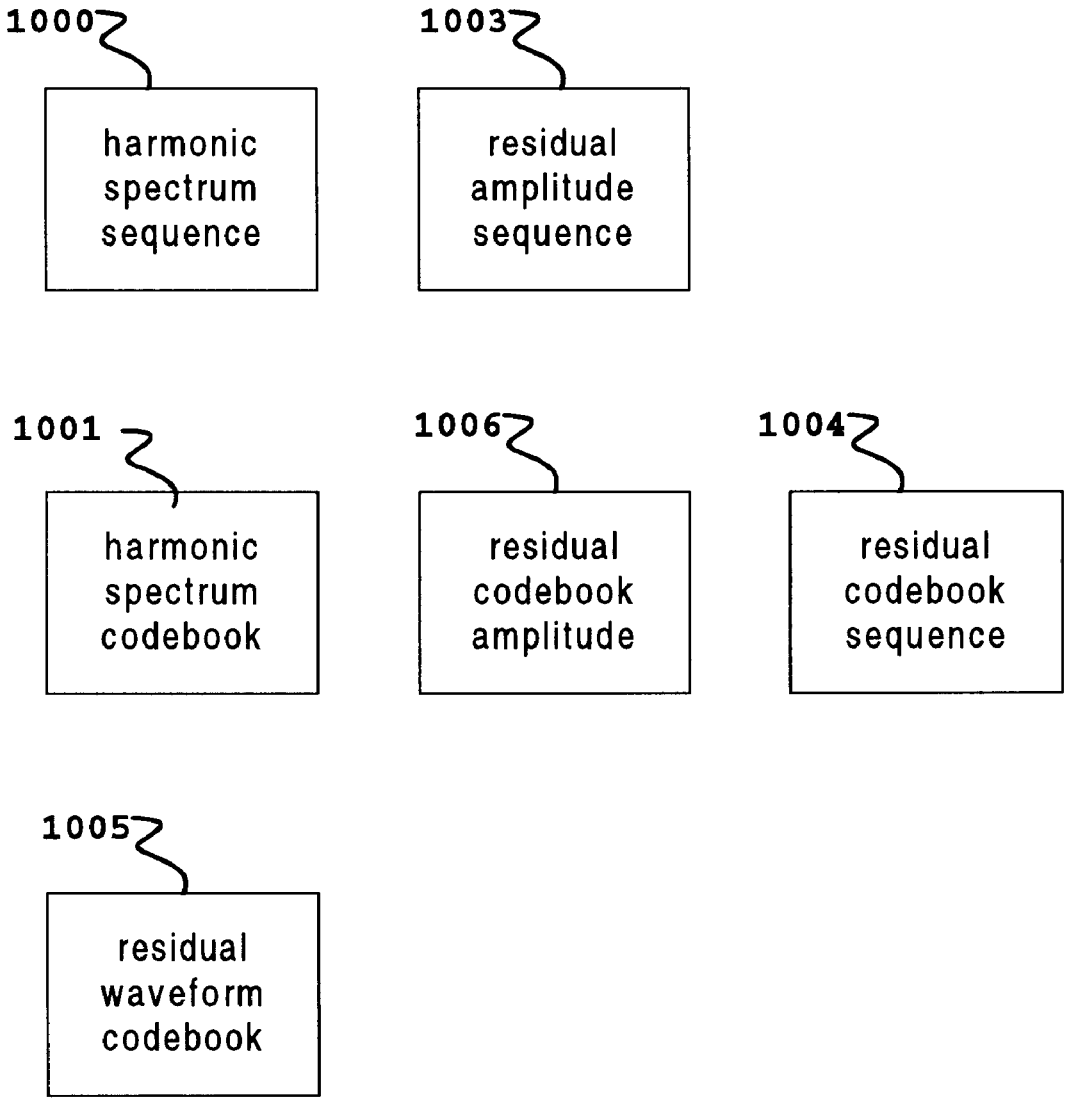
FIG. 10 shows data objects associated with one embodiment of the residual tonal signal encoder using vector quantization based on the time-varying harmonic spectrum of the residual tonal signal.

FIG. 10 shows a block diagram of the data objects associated with another embodiment of the residual tonal signal encoder. The data objects are similar to those in the embodiment of FIG. 6. The embodiment associated with the data objects of FIG. 10 performs operations of VQ coding and residual waveform codebook generation similar to those described for FIG. 6. However, a sinusoidal encoding is performed on the residual tonal signal and the VQ coding and residual waveform codebook generation is performed on the harmonic spectrum rather than the magnitude spectrum. In FIG. 10 the harmonic spectrum sequence, 1000, and the harmonic spectrum codebook, 1001, replace the magnitude spectrum sequence, 600, and the magnitude spectrum codebook, 601, of FIG. 6. Otherwise, the embodiment of FIG. 10 has all the same data objects as FIG. 6, except that no residual codebook pitch is used.

Figure 11:
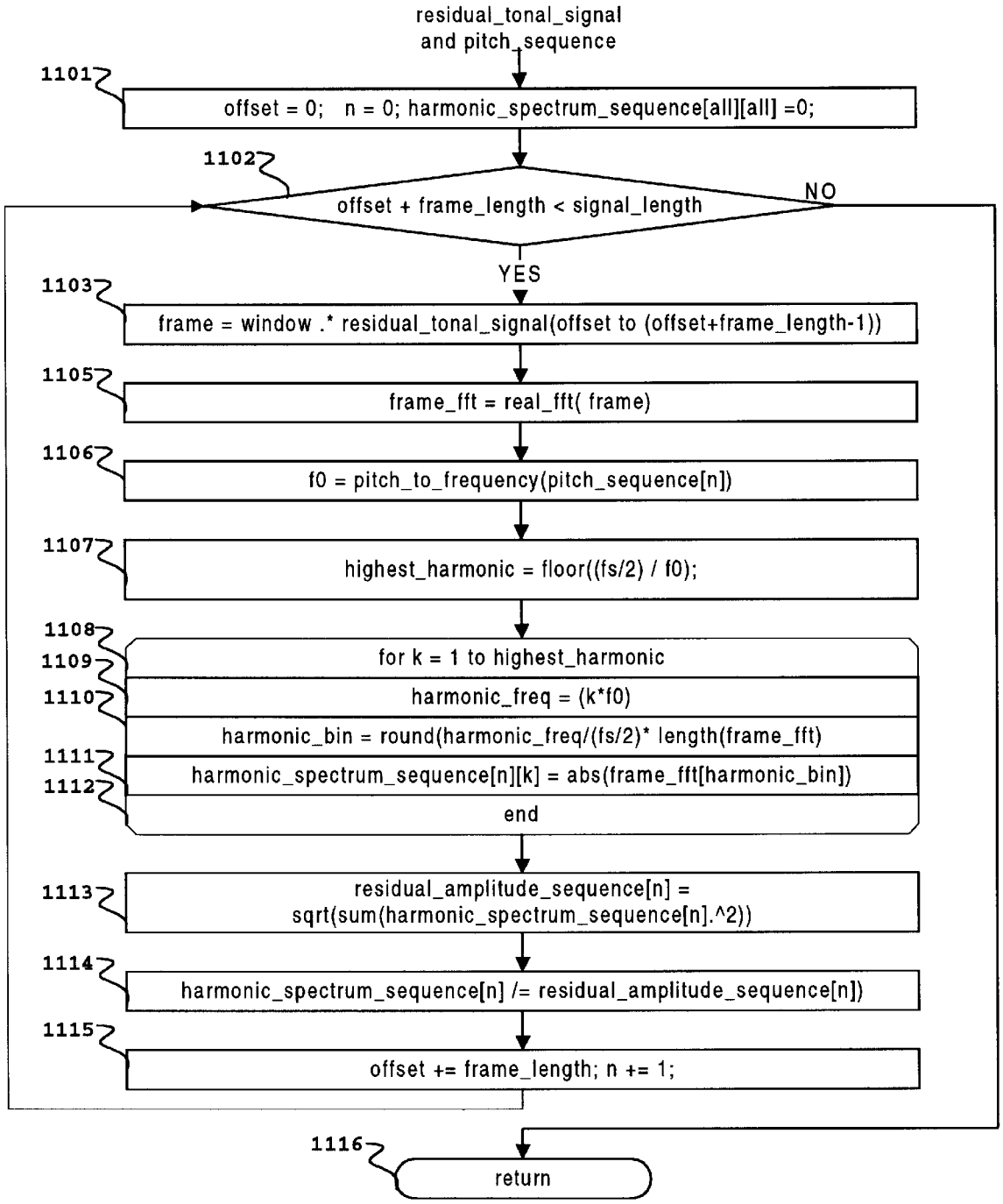
FIG. 11 shows a flow diagram of the generation of the harmonic spectrum sequence of FIG. 10.

FIG. 11 shows a flow diagram of the operation that fills the harmonic spectrum sequence, 1000 of FIG. 10. The operation is quite similar to the sinusoidal encoding described for the low-frequency band in FIG. 5. In 1100 and 1101, the n and offset variables are initialized to zero and all values of the harmonic spectrum sequence are set to zero. In 1102, a test is made to see if there are another frame_length samples beginning at offset in the residual tonal signal. If so, then blocks 1103 to 1114 calculate a set of residual sinusoidal parameters for the new frame. In 1103, the frame is multiplied by a tapered window function. No zero-padding is used in the residual case, since less frequency resolution is needed. In 1105, the FFT of the windowed frame is taken.

In 1106, the pitch estimate for the current frame is retrieved from the pitch sequence. The residual sinusoidal frequencies are assumed to begin with f0 and continue with all harmonics at integer multiples of f0 up to half the sampling frequency. In the event that the residual tonal signal is the high-frequency part of the original magnitude spectrum, the lower harmonics will be near zero. In the event that the residual tonal signal is generated with a zeros-filter, then the harmonics near zero locations will have near zero power. Block 1108 is the beginning of a loop over each residual harmonic. In 1109, the harmonic frequency is set as a multiple of f0. In 1110, the FFT bin (harmonic bin) corresponding to this frequency is calculated. In 1111, the harmonic spectrum sequence value for the current frame and the current harmonic number is set equal to the magnitude of the complex spectrum value in frame_fft[harmonic bin]. No phase or frequency value is saved for residual harmonics. The loop continues, setting the magnitude for each harmonic of the current frame.

In 1113 the residual amplitude sequence value for the current frame is set as the square root of the sum of squares of the harmonic spectrum magnitudes, and in 1114 the harmonic spectrum is normalized by this amplitude.

After the loop ends, in 1115, the offset is incremented by frame_length/2 because of the 2 to 1 overlap, and n, representing the frame count, is incremented by 1. Flow of control passes back to 1102. If there are another frame_length samples in the low-frequency signal then the harmonic spectrum for the next frame is computed. If not, the function returns in 1116.

Those skilled in the art of harmonic encoder design will understand that many techniques can be used to determine time-varying harmonic spectra. The character of the present invention does not depend on the specific technique used.

Figure 12:
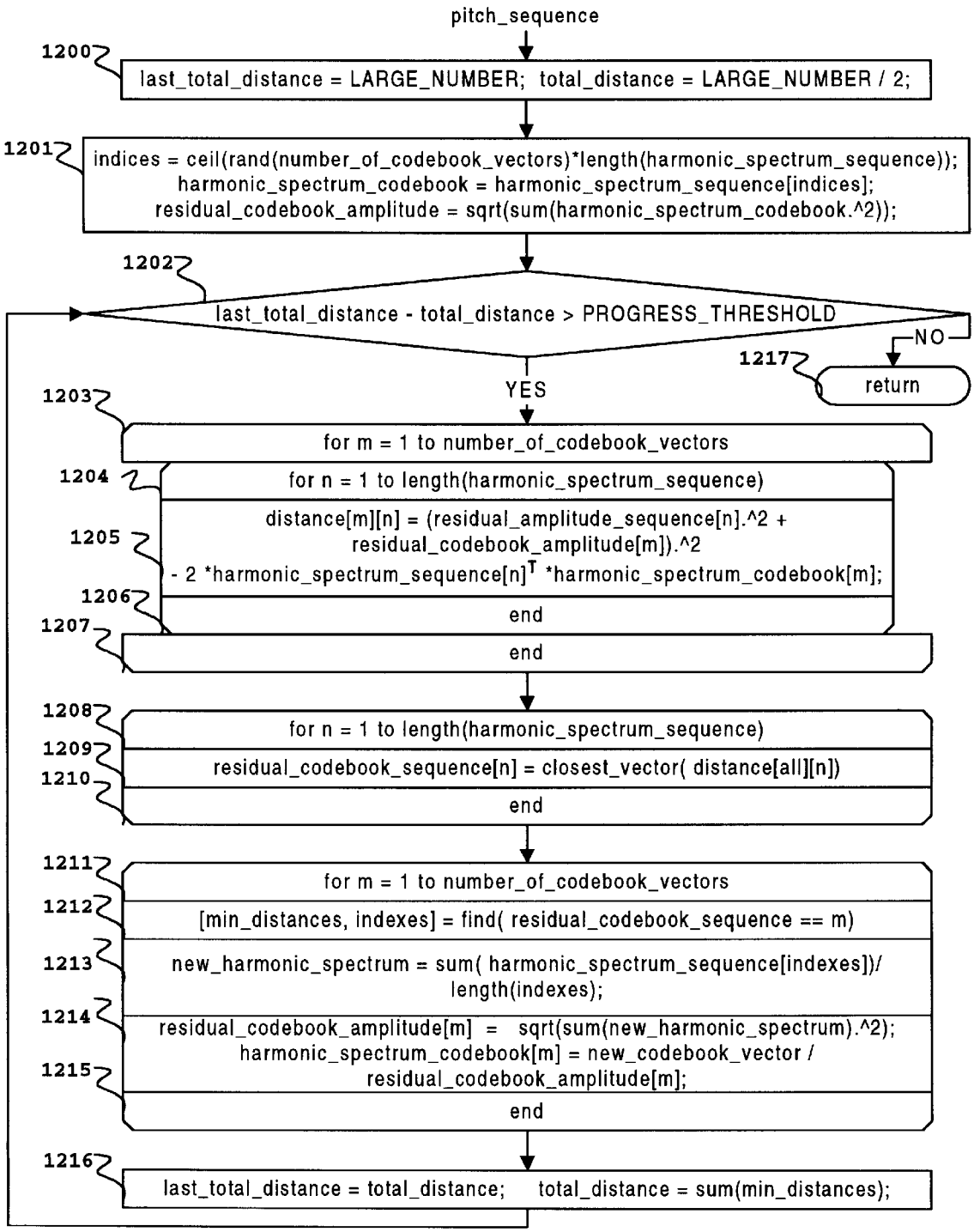
FIG. 12 shows a flow diagram of the generation of the harmonic spectrum codebook and residual codebook sequence of FIG. 10.

FIG. 12 shows a flow diagram of the VQ coder that fills the harmonic spectrum codebook, 1001 of FIG. 10. The harmonic spectrum codebook VQ coder is much like the coder of FIG. 5. In 1200, the variables last total distance and total distance are initialized. In 1201, the codebook is filled with harmonic vectors selected at random from the magnitude spectrum sequence. The residual codebook amplitude is filled with the square root of sum of squares of these magnitude spectra.

In 1202, the rate of progress of the coding is tested. If this difference is not greater than a pre-defined PROGRESS_THRESHOLD then the VQ coding algorithm is exited in 1217. Otherwise, another iteration is executed.

In the nested loop, 1203 through 1207, the distance from every harmonic vector in the harmonic spectrum codebook to every harmonic vector in the harmonic spectrum sequence is computed. Unlike FIG. 8, there is no pitch penalty associated with this distance metric. In the loop 1208 to 1210, the harmonic spectrum codebook sequence is filled in a manner identical to FIG. 8. In the loop 1211 through 1215, the harmonic spectrum codebook is updated. This is also quite similar to FIG. 8. The residual codebook amplitude is also updated.

Figure 13:
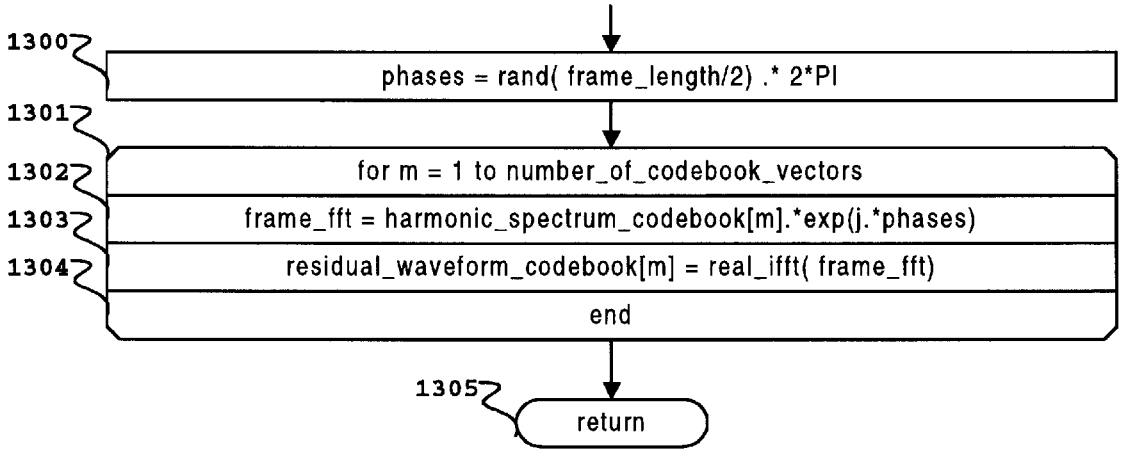
FIG. 13 shows a flow diagram of the generation of the residual waveform codebook, and residual codebook amplitude of FIG. 10.

The next step is to compute the residual waveform codebook, 1005 of FIG. 10. FIG. 13 shows a flow diagram of the residual waveform codebook generation operation. Each residual waveform is the sum of harmonically related residual sinusoids with amplitudes equal to the values in the harmonic spectrum codebook vectors. The residual waveforms are generated by inverse Fourier transforming the harmonic vectors in the harmonic spectrum codebook, 1001 of FIG. 10. To avoid a high crest factor waveform and a "buzziness" in the synthesized residual tonal signal, the phases of the harmonics are set to a random phase vector. This random phase vector is determined in 1300 and is the same for all vectors in the residual waveform codebook. Since each bin of the harmonic vector defines the amplitude and phase of a separate sinusoid, the inverse transform results in a residual waveform that represents one period of a perfectly periodic waveform whose length is the length of the inverse transformed vector.

The embodiment of FIG. 10 through FIG. 13 differs from that of FIG. 6 through FIG. 9 in that the residual waveform codebook represents perfectly periodic synthetic residual waveforms based on a sum of residual sinusoids. The embodiment of FIG. 6 through FIG. 9 selects residual waveform segments from the original residual tonal signal. Both embodiments produce a residual waveform codebook with a collection of residual time-domain waveforms representative of the magnitude spectra of the residual tonal signal.

In the embodiment of FIG. 10 through FIG. 13, the encoded residual tonal signal consists of residual waveform codebook 1005, residual codebook sequence 1004, and residual amplitude sequence 1003. These are sent together with the dominant sinusoid parameter sequence and pitch sequence from 101 of FIG. 1 to the mass storage or communications channel 103.

Figure 14:
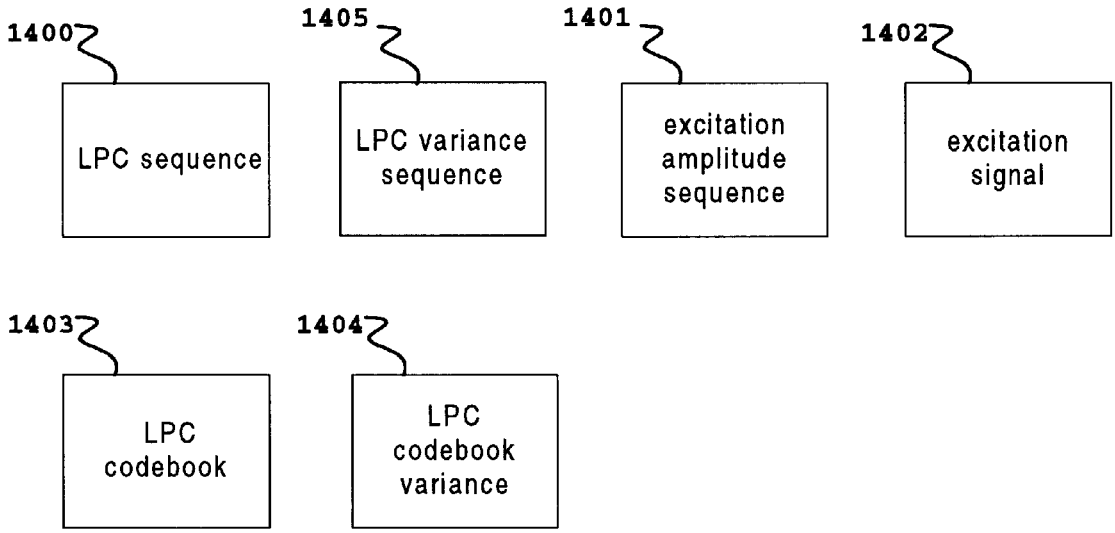
FIG. 14 shows data objects associated with one embodiment of the residual tonal signal encoder using vector quantization based on LPC analysis of the residual tonal signal.

FIG. 14 shows the data objects associated with yet another embodiment of the residual tonal signal encoder of the present invention. In this embodiment, the residual tonal signal is encoded using linear prediction coding (LPC) techniques. The resulting a sequence of LPC coefficients 1400, an excitation amplitude sequence 1401, and an excitation signal, 1402. The LPC sequence, 1400, is VQ coded to form LPC codebook, 1403. The VQ coding uses LPC codebook variance 1404 and LPC variance sequence 1405.

Figure 15:
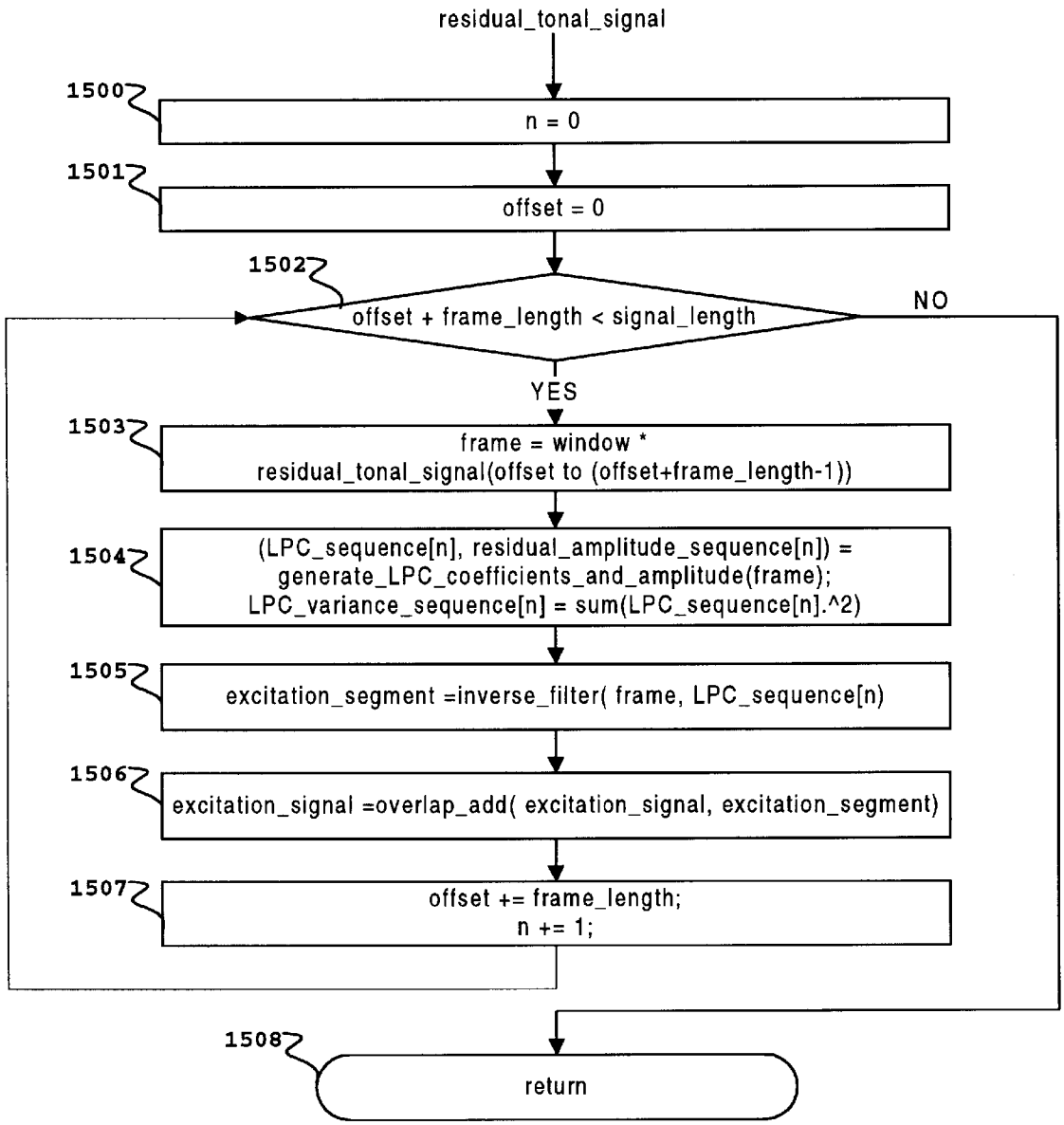
FIG. 15 shows a flow diagram of the generation of the LPC sequence of FIG. 14.

FIG. 15 shows a flow diagram of the operation that generates the data objects of FIG. 14. The operation is frame based like the VQ coding techniques discussed previously. In 1500 and 1501 the variables n and offset are initialized. In 1502, a test is made to determine if another frame_length samples remain in the residual tonal signal. If so, then in 1503, the frame is multiplied by a tapered window. In 1504, the generate LPC coefficients and amplitude function is called for the current frame. There are many techniques for generating LPC filter coefficients. These techniques include the auto-correlation method, the covariance method, and the modified covariance method. These and other techniques are well known to those skilled in the art of linear predictive coding. The character of the present invention is not affected by the specific choice of LPC technique. Because the techniques are so well established, we do not show details in this specification. All of the LPC techniques provide a set of LPC filter coefficients and an excitation amplitude value for the frame. In 1504, the generate LPC coefficients and amplitude function returns both the coefficients and amplitude value. These are stored in the LPC_sequence 1400, and excitation amplitude sequence 1401 of FIG. 14. In addition, in 1504, the LPC variance sequence value is generated as the sum of squares of the LPC coefficients.

In 1405 the waveform segment associated with the current frame is inverse filtered by the LPC filter coefficients to generate the excitation signal segment for the current frame. Since the residual tonal signal is already at a low level relative to the dominant sinusoid components, the excitation signal may be at an extremely low level. If medium fidelity is required, the excitation signal can be discarded and only the excitation amplitude sequence saved. On synthesis, in this case, the excitation signal is synthesized as a pulse train, multi-pulse sequence, or sum of equal amplitude sinusoids with random phases. For higher fidelity applications, the excitation signal can be encoded using one of the VQ coding techniques described above for the residual tonal signal.

Figure 16:
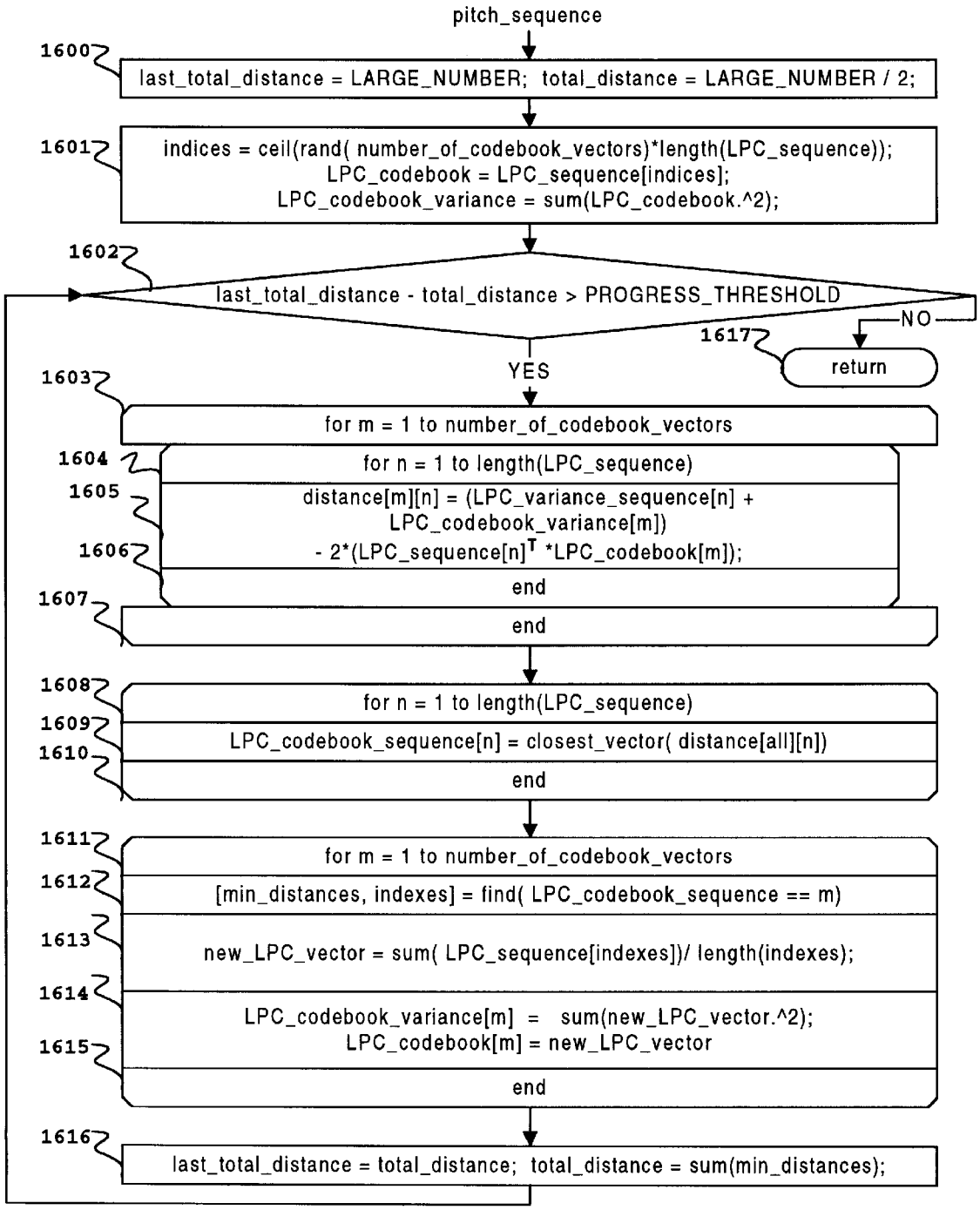
FIG. 16 shows a flow diagram of the generation of the LPC codebook of FIG. 14.

The filter coefficients in the LPC sequence are vector quantized to reduce the number of coefficients stored or transmitted. FIG. 16 shows a flow diagram of the VQ coder for the LPC coefficients. It is much like the harmonic VQ coder of FIG. 12. The coder makes use of data objects in FIG. 14. These objects are the same as for FIG. 10 except that the LPC variance sequence, 1405 and the LPC codebook variance 1404 replace the residual amplitude sequence and residual codebook amplitude.

In another embodiment, the VQ coding of the LFC sequence may be omitted and the LPC sequence stored directly in the storage device of communications channels 103 of FIG. 1. This is justified since the purpose of VQ coding is to reduce the number of parameters and LPC already has a reduced number of parameters.

LPC uses an all-pole filter model. This may also be referred to as AR modeling or coding. ARMA modeling uses a filter with poles and zeros. In another embodiment, LPC is replaced with ARMA modeling. The choice does not affect the character of the present invention.

With LPC and ARMA coding, the residual signal is characterized by a time-varying magnitude spectrum represented as filter coefficients for an all-pole or pole-zero filter. The residual signal is then filtered by the inverse of this time-varying spectrum to produce the excitation signal and excitation amplitude sequence. The magnitude spectrum coding parameters—in this case the filter coefficients—can be vector quantized to from a magnitude spectrum codebook, or simply sent as a sequence of spectrum coding vectors. When vector quantization is used, the residual codebook sequence represents unique magnitude spectrum coding vector numbers, where each number selects a magnitude spectrum coding vector in magnitude spectrum codebook.

The excitation signal can also be vector quantized or sent as a simple sample stream. The excitation signal can also be discarded and replaced by a synthetic excitation with amplitude envelope characterized by the excitation amplitude sequence. Any techniques that can be used to characterize the time-varying residual magnitude spectrum and inverse filter the residual tonal signal to yield the excitation signal can be used effectively in the present invention.

The embodiments of the dominant sinusoid encoder and the residual tonal signal encoder described above are frame-based systems that generate a parameter set once per frame. However, it is not necessary for the frame rates to be the same for both encoders. In particular, when the separation of dominant and residual tonal signal components is based on frequency-dominant sinusoids at low frequencies, residual tonal signal at high frequencies then the frame rate for the residual tonal signal can be faster with a shorter frame_length. This permits faster parameter update at higher frequencies, which results in higher-fidelity for rapidly changing audio signals.

Many pitched audio signals such as violin, trumpet, saxophone, voiced speech, and many types of singing, exhibit a period doubling phenomenon. That is, for the most part the sound appears to be centered at a main pitch—e.g. A440—but occasionally lower amplitude sinusoid components appear at lower frequencies and between the harmonics of the main pitch. The lower frequency subharmonic sinusoid components generally appear at a musical interval of one fifth, one octave, one octave plus a fifth, or two octaves below the main pitch For the pitch-based encoding techniques described above, this behavior can be captured by first dividing the fundamental frequencies f9 corresponding to pitch sequence by two, three, four . . . before using them in the encoding process. In this way, subharmonics are effectively encoded and synthesized.

Blocks 104,105,106, and 107 of FIG. 1 comprise the tonal audio signal synthesizer according to the present invention. The dominant sinusoid parameter stream is read out of the mass storage or communication channel, 103, and input to the sinusoidal oscillator bank 104.

Figure 19:
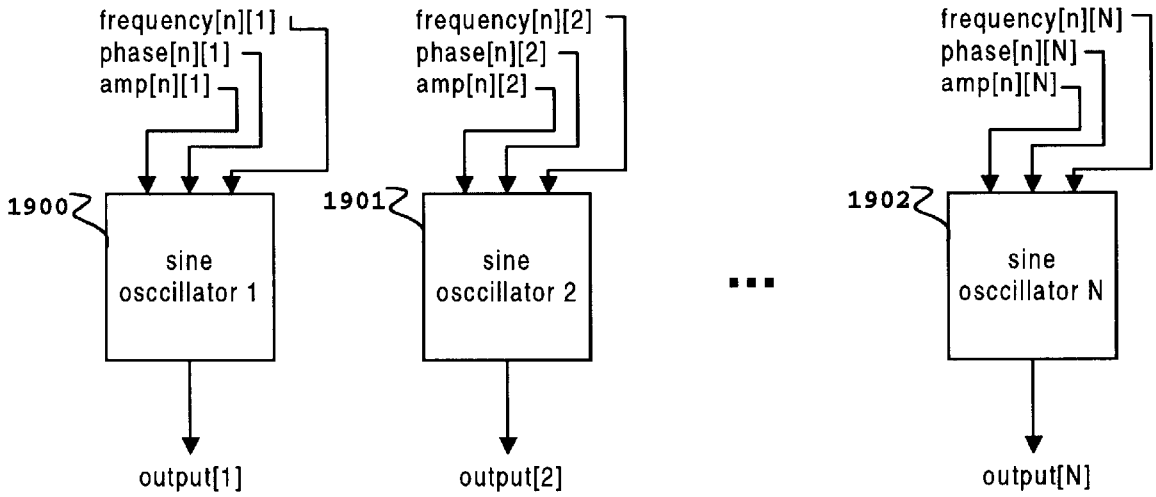
FIG. 19 shows a block diagram of the sinusoidal oscillator bank of FIG. 1.

FIG. 19 shows a block diagram of one embodiment of a sinusoidal oscillator bank according to the present invention. The oscillator bank comprises a set of independent sinusoidal oscillators 1900, 1901, and 1902. The specific number of oscillators depends on the number of dominant sinusoid components. In FIG. 19, frequency[n] [m] refers to the frequency value of the mth dominant sinusoid at the nth frame in the dominant sinusoid parameter sequence. Likewise, phase[n] [m] and amp[n] [m] refer to the phase and amplitude values of the mth dominant sinusoid at the nth frame in the dominant sinusoid parameter sequence.

Figure 20:
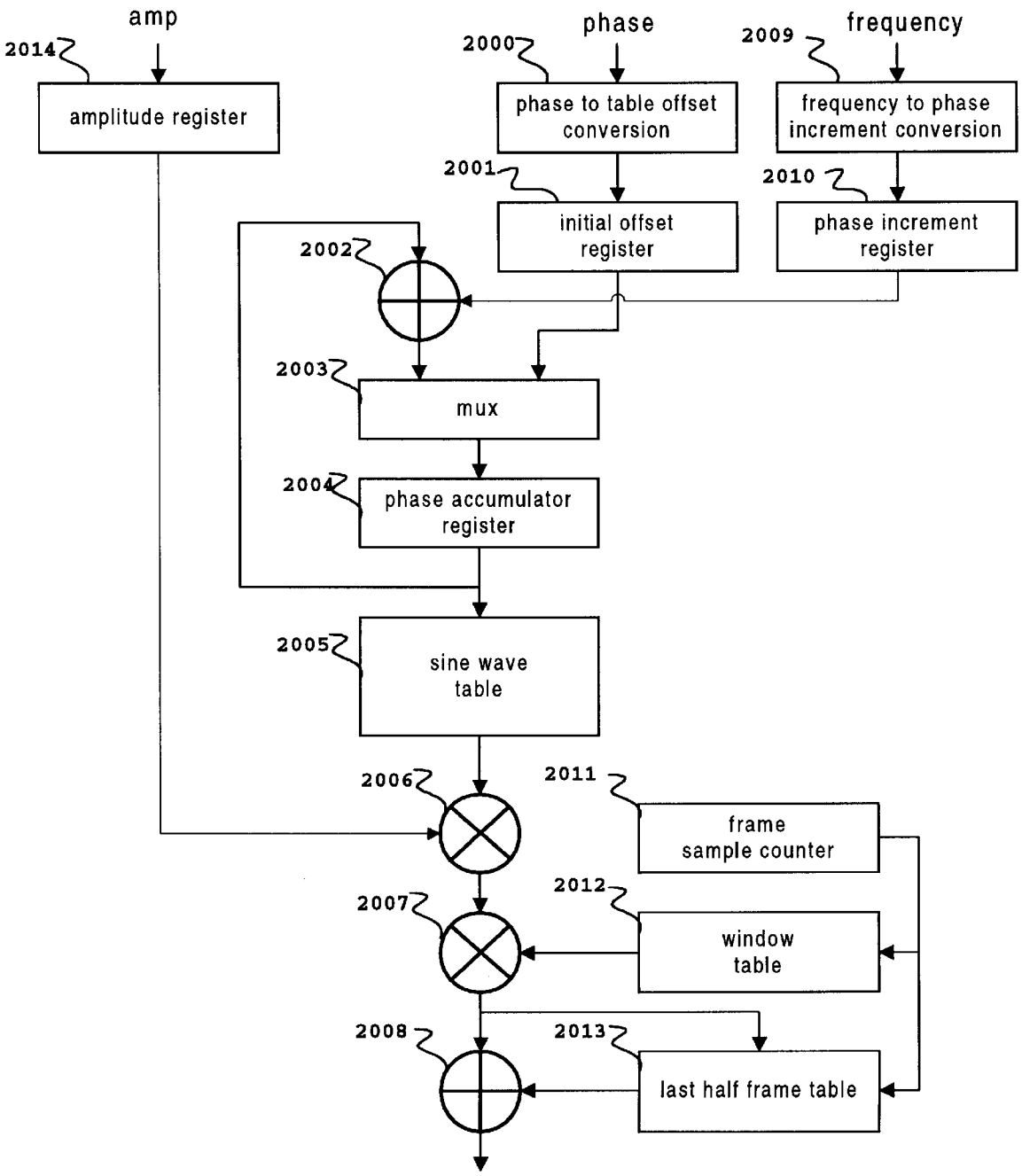
FIG. 20 shows a block diagram of one embodiment of a truncating sinusoidal oscillator with windowed overlap-add output.

FIG. 20 shows one embodiment of a sinusoidal oscillator according to the present invention. The phase is converted to a sine wave table address offset in 2000 and clocked into the initial offset register at the beginning of every frame. Likewise, frequency is converted to phase increment in 2009 and clocked into the phase increment register 2010 at the beginning of every frame. The amp value is also clocked into the amplitude register 2014 at the beginning of each frame. Both phase increment and initial offset values are in integer plus fraction format, where the integer points to a specific sample value in the sine wave table and the fraction specifies a distance between adjacent sample values in the table, corresponding to the precise location of the desired output sample. Note that a new frame begins every frame_length/2 output samples, due to the 2 to 1 frame overlap. The oscillator embodiment of FIG. 20 synthesizes frame_length windowed sample blocks that are overlap-added to generate a continuous output.

At the beginning of a frame, mux 2003 selects the initial offset register value, whose value is clocked into the phase accumulator register 2004. The value at the location pointed to by the integer part of the phase accumulator register is read out from the sine wave table 2005 and multiplied, 2006, by the value in the amplitude register 2014. After a value is read from the sine wave table, the mux 2003 is switched to select the output of adder 2002, which forms the sum of the current value of the phase accumulator register and the phase increment value. The incremented phase accumulator value is clocked into the phase accumulator register 2004. The phase accumulator register is incremented in this way for the next frame_length-1 samples and the corresponding values of the sine wave table, 2005, are read out.

The window table, 2012, stores a frame_length tapered window suitable for 2 to 1 overlap-add, such as a hanning window. The frame sample counter, 2011, is reset to zero at the beginning of every frame. For every sample output, the frame sample counter is incremented by one. The window value at the location pointed to by frame sample counter, 2011, is fetched out of the window table, 2012, and the amplitude scaled sine wave table output is multiplied by this window value. Therefore, the first frame_length/2 amplitude scaled sine wave values for a new frame are multiplied by first half of the Window. These windowed values are added, 2008, to the second frame_length/2 amplitude scaled sine wave values from the previous frame. These values were stored in the last half frame table 2013 during the previous frame. The values in the last half frame table 2013 were multiplied by the second half of the window. This summation implements the overlap-add function. After these frame_length/2 overlap-added samples are output from the oscillator, the second frame_length/2 amplitude scaled sine wave values are multiplied by the second half of the window and stored in the last half frame table 2013, in preparation for the next frame.

This process continues, generating frame_length/2 output samples every frame. In the embodiment of FIG. 20, no interpolation is performed between sine wave table values. The value located at the integer part of the integer plus fraction phase accumulator register is the value read out. This is referred to as a truncating table lookup oscillator. This truncation without interpolation results in distortion. However, the distortion can be minimized if a sufficiently large sine wave table is employed. This is especially true since the dominant sinusoid components are usually fairly low-frequency and are less susceptible to distortion due to phase accumulator truncation. If one full cycle of a sine wave is stored in the table then the table size should be 16K samples or more for suitable performance. The length of the sine wave table is always a power of two and equal to the maximum integer part of the phase accumulator+1 so that the phase accumulator wraps back to the beginning of the sine wave table when it overflows.

In another embodiment, the initial offset register value in 2001 is clocked into the phase accumulator at the beginning of the first frame only. On subsequent frames the value frame_length/2 is subtracted from the phase accumulator register 2004 to compensate for the 2 to 1 overlap in the output.

The overlap-add with a tapered window function has the implicit effect of interpolating the frequency, amplitude, and phase control parameters which are updated every frame_length/2 samples.

Figure 21:
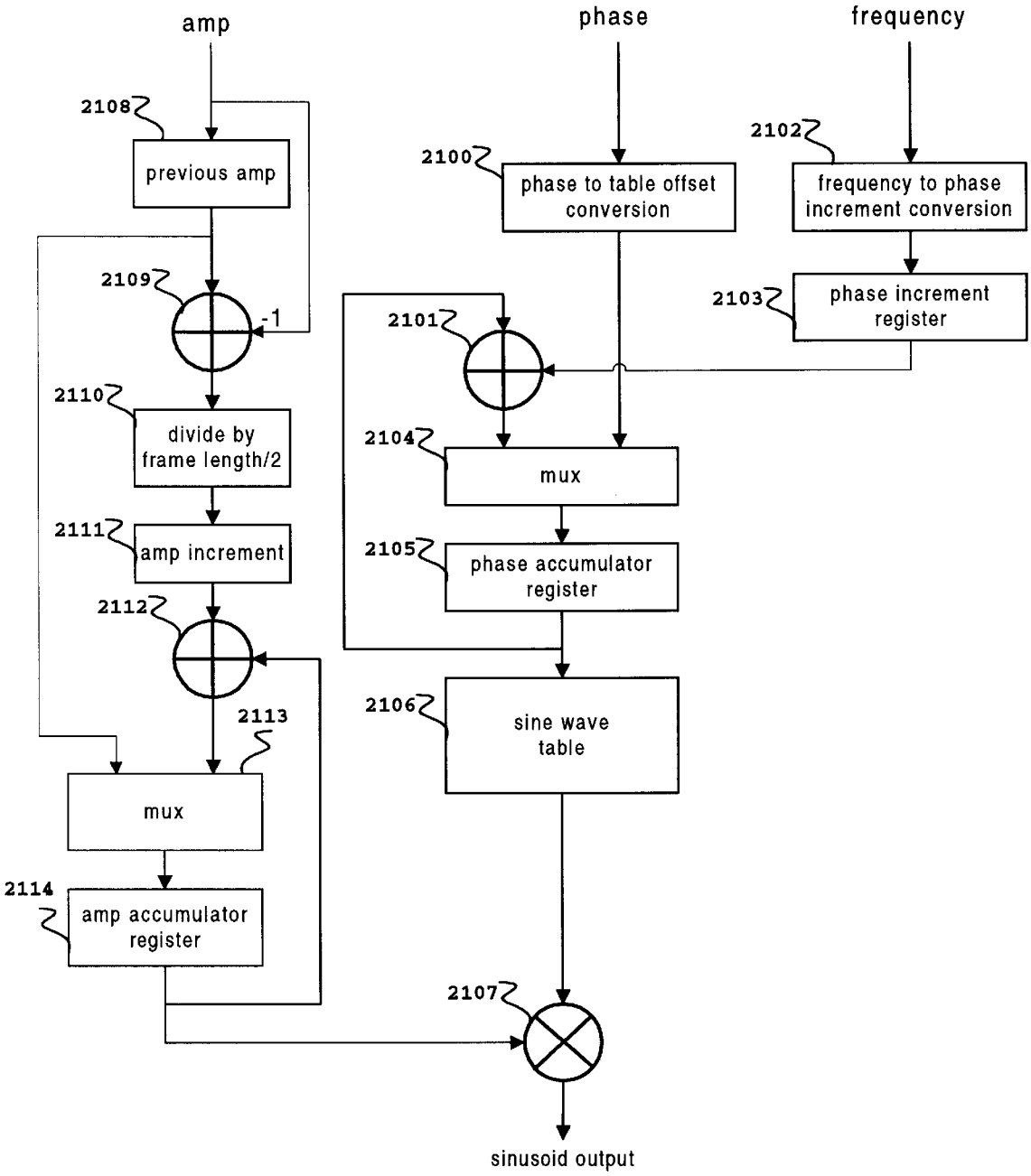
FIG. 21 shows a block diagram of one embodiment of a truncating sinusoidal oscillator with interpolated amplitude control parameter.

FIG. 21 shows another embodiment of the truncating table lookup sinusoidal oscillator according to the present invention. The embodiment of FIG. 21 explicitly interpolates the amplitude input control value and performs no overlap-add. The frequency value is not interpolated over the frame. This produces acceptable results, as the oscillator output is relatively insensitive to discontinuities in the frequency control parameter. The phase value for the first frame is converted to table offset 2100, selected by mux 2104, and clocked into the phase accumulator register 2105 at the beginning of the first frame. Thereafter, no new phase values are used and the phase accumulator register is continually incremented by phase increment register value 2103 across frames. The frequency input is converted to phase increment, 2102, and clocked into the phase increment register 2103 at the beginning of every frame. No subtraction of frame_length/2 samples is performed at the phase accumulator because no overlap-add is used.

At the beginning of every frame, the amp input value is subtracted, 2109, from the previous amp input value stored in 2108. This difference is divided by frame_length/2, 2110, to generate an amp increment value that is stored in 2111. The previous amp input value, 2108, is selected by mux 2113 and clocked into amp accumulator register 2114, after which amp input is clocked into the previous amp input register, 2108. For the next frame_length/2–1 samples the amp increment value, 2111, is selected by mux 2113, and added, 2112, to the current amp accumulator register value, 2114, to form the next amp accumulator register value. At the end of the frame the amp accumulator register should hold the value of (input amp—amp increment), and one more addition, 2112, would cause it to equal input amp. However, due to round-off error the value is somewhat inaccurate. Therefore, at the beginning of the next frame the input amp value, which was already stored in the previous amp register, 2108, is selected by mux 2113 and clocked into amp accumulator register 2114. This process continues for every new frame. The sample-by-sample updated output of the amp accumulator register 2114, is multiplied, 2107, by the sample-by-sample output of the sine wave table 2106, to form the sinusoidal output. The rest of the embodiment of FIG. 21, behaves identically to the embodiment of FIG. 20, except the overlap-add circuitry is removed.

Figure 22:
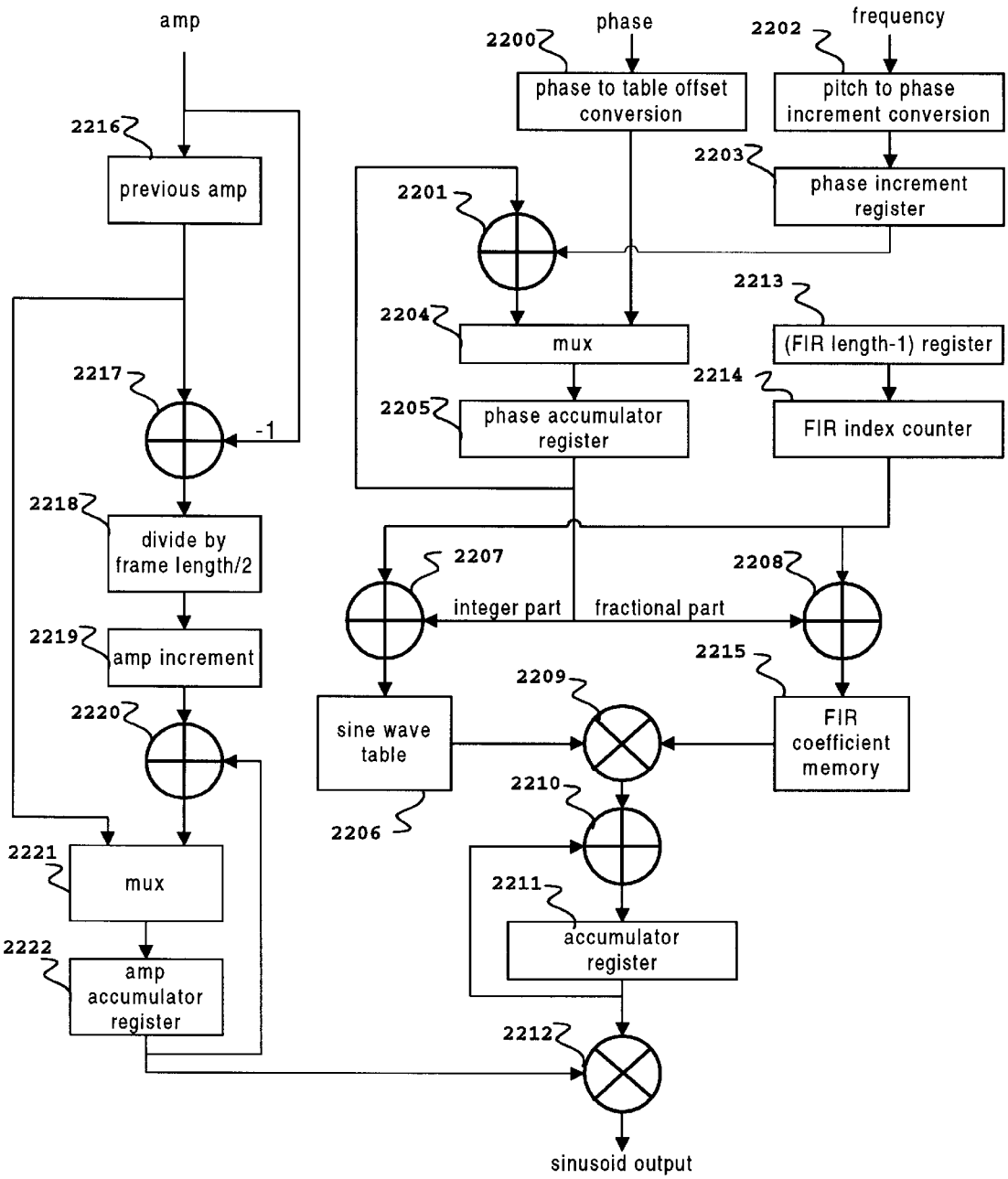
FIG. 22 shows a block diagram of one embodiment of an interpolating sinusoidal oscillator with interpolated amplitude control parameter.

FIG. 22 shows an embodiment of an interpolating sinusoidal oscillator according to the present invention. The embodiment of FIG. 22 uses the same input amp interpolation circuitry as FIG. 21, and treats frequency and phase inputs in the same way. However, the embodiment of FIG. 22 uses the fractional part of the phase accumulator register output, 2205, to interpolate between adjacent values in the sine wave table, 2106. This allows a smaller sine wave table to be used and permits reduced distortion.

The interpolation performed in FIG. 22 uses multirate polyphase FIR filtering, which is well known to those skilled in the art of wavetable interpolation or sample rate conversion. With this technique, every output sample is formed as the inner-product of a vector of adjacent samples from the sine wave table, 2206, and a vector of filter coefficients from the FIR coefficient table 2215. The integer part of the phase accumulator register, 2205, points to the first element of the vector of adjacent sine wave samples. The fractional part of the phase accumulator register, 2205, points to the first element of the vector of filter coefficients. To implement the inner-product operation the accumulator register, 2211, is first cleared and the value of FIR_length-1 stored in 2213, is clocked into the FIR index counter, 2214. Each accumulator cycle the phase accumulator integer is added, 2207, to the FIR index and the sine wave table value pointed to by this sum is read out and multiplied with the coefficient at location (phase accumulator fraction+FIR index) in the FIR coefficient table. The product is added to the current contents of the accumulator register, 2211, and the FIR index counter is decremented. The adder, 2207, has only enough output bits to address the complete sine wave table so that, if the sum overflows, the address wraps back to the beginning of the sine wave table. After FIR_length accumulator cycles the accumulator register value, 2211, is multiplied, 2212, by the output of the amp accumulator register 2222, to form the next sinusoidal output. The phase accumulator register, 2206, is then incremented by the phase increment value, 2203, as in the previous embodiments, and the amp accumulator register is incremented by amp increment, as in the embodiment of FIG. 21. This process continues for all frames.

In another embodiment of the sinusoidal oscillator according to the present invention, the multirate polyphase FIR filter interpolator can be used with an overlap-add output system with tapered windowing. In this case, the amplitude interpolation circuitry is removed, and the windowed overlap-add circuitry of FIG. 20 is added to provide the interpolation functionality.

In another embodiment of the sinusoidal oscillator according to the present invention, linear interpolation between sine wave table values is performed. With linear interpolation each interpolated sine wave table output is determined as:

phase_integer=phase accumulator integer part;

phase_fraction=phase accumulator fractional part;

sine_table=sine wave table;

```
output=(1-phase_fraction)*(sine_table[phase_integer])+phase_
    fraction*(sine_table[phase_integer+1]);
```

This is equivalent to the multirate polyphase FIR filtering interpolation of FIG. 22, with a FIR_length of two.

Figure 23:
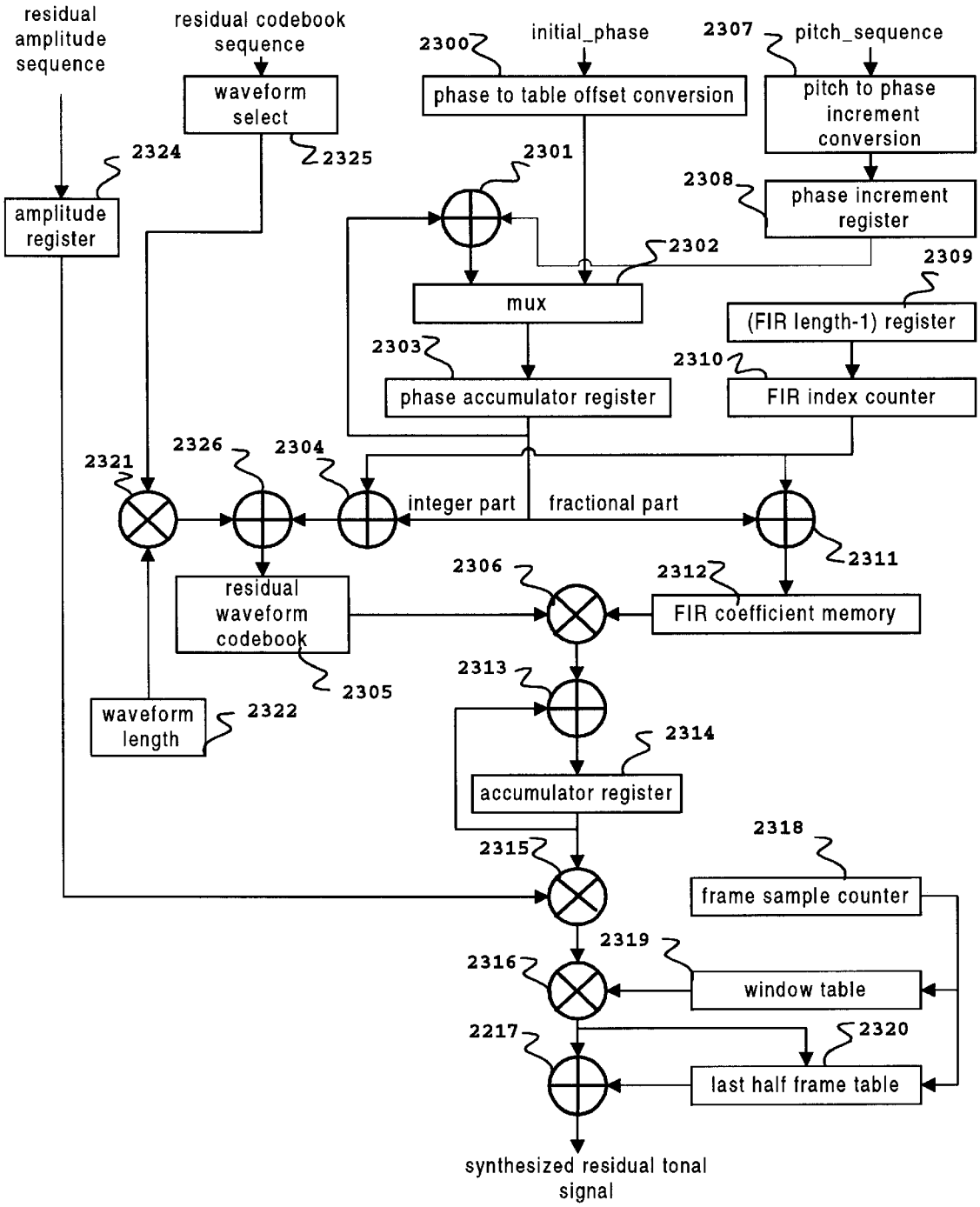
FIG. 23 shows a block diagram of one embodiment of an interpolating residual tonal signal synthesizer with windowed overlap-add output.

FIG. 23 shows one embodiment of the residual tonal signal synthesizer corresponding to block 106 of FIG. 1. The embodiment of FIG. 23 is used to resynthesize a residual tonal signal that has been encoded using a residual tonal signal encoder corresponding to the embodiment of FIG. 6 through FIG. 9, or the embodiment of FIG. 10 through FIG. 13. Both of these embodiments generate a residual waveform codebook.

The embodiment of FIG. 23 is very similar to the interpolating sinusoidal oscillator embodiment of FIG. 22, but with windowed overlap-add output and no amplitude interpolation. In FIG. 23, the sine wave table, 2206 of FIG. 22, has been replaced by the residual waveform codebook 2305. The residual waveform codebook, 2305, is the same codebook that was generated by the residual tonal signal encoder, and corresponds to 1005 of FIG. 10, or 605 FIG. 6. The residual tonal signal encoder generated a residual amplitude sequence and a residual codebook sequence that were sent to the storage device or communications channel, 103 of FIG. 1. The dominant sinusoid encoder generated a pitch sequence that was also sent to 103.

In the residual tonal signal synthesizer embodiment of FIG. 23, at the beginning of every frame, a residual amplitude sequence value, residual codebook sequence value, and pitch sequence value are read out of 103 to form the input of the synthesizer for the new frame. At the beginning of the very first frame a random initial phase value is generated, selected by mux 2302, and clocked into the phase accumulator register 2303. Thereafter, no new initial phase values are clocked into 2303.

At the beginning of every frame a new residual codebook sequence value is clocked into the wave select register, 2325. This value is multiplied, 2321, by the waveform length, 2322. All waveforms in the residual waveform codebook, 2305, are the same length. The length is a power of two and is equal to the largest possible integer+1 in the integer part of the phase accumulator register, 2303. The output of multiplier 2321 points to the starting address in the residual waveform codebook, 2305, of the selected waveform for the current frame.

The phase accumulator integer part and the FIR index counter value, 2310, are summed, 2304. The maximum output of the adder, 2304, is waveform length, 2322, minus one. So if the sum in 2304 overflows, it wraps around modulo waveform length. This sum is added, 2326, to the waveform starting output from 2321 to form the complete residual waveform codebook address.

The phase accumulator, FIR index counter, and inner-product circuitry function in the same way as the embodiment of FIG. 22. Values output from the residual waveform codebook are multiplied, 2315, by the output of the amplitude register, 2324. The amplitude register is loaded with a new residual amplitude sequence value every frame.

The embodiment of FIG. 23 uses tapered windowing and overlap-add. The windowing and overlap-add operation is identical to the embodiment of FIG. 20. Frame_length/2 is subtracted from the phase accumulator register, 2203, at the beginning of every frame to compensate for the overlap-add.

As in the embodiment of FIG. 20, the overlap-add mechanism implicitly interpolates amplitude and frequency over the duration of a frame. In addition, in the embodiment of FIG. 23, the overlap-add mechanism also implicitly interpolates the magnitude spectra of the codebook waveforms, since the waveforms may change each frame as a function of the residual codebook sequence.

If the residual waveform codebook was generated from the residual tonal signal encoder embodiment of FIG. 10 through FIG. 13, then all waveforms in the residual waveform codebook have the same randomized phase response. This means that there will be no phase cancellation during overlap-add. The output magnitude spectrum during overlap-add will be the window-weighted sum of magnitude spectra of the overlapped waveforms.

If the residual waveform codebook was generated from the residual tonal signal encoder embodiment of FIG. 6 through FIG. 9, then there is no guarantee against phase cancellation during overlap-add.

Figure 24:
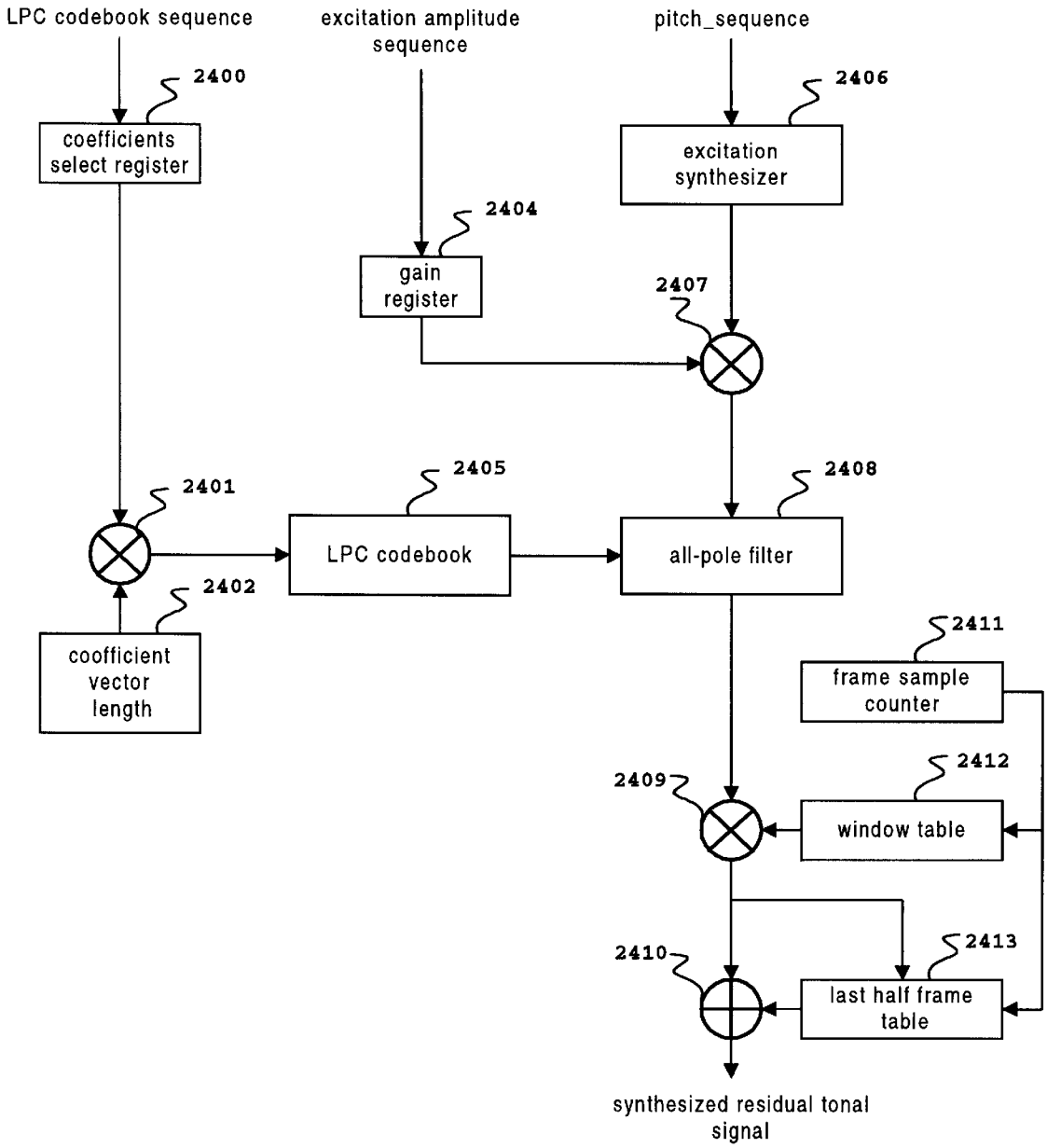
FIG. 24 shows a block diagram of one embodiment of a vector quantized LPC residual tonal signal synthesizer with windowed overlap-add output.

FIG. 24 shows a flow diagram of yet another embodiment of a residual tonal signal synthesizer according to the present invention. The embodiment of FIG. 24 is used in conjunction with the LPC residual tonal signal encoder embodiment of FIG. 14, FIG. 15, and FIG. 16. At the beginning of every frame, a new residual codebook sequence value is read from the mass storage device or communications channel, 103 of FIG. 1. The residual codebook sequence value is stored in coefficients select register 2400. The value in 2400 is multiplied, 2401, by the coefficient vector length, 2402, to form the address in the LPC codebook, 2405, of the LPC all-pole filter coefficient vector that is to be used for the current frame. The LPC codebook, 2405, corresponds to the LPC codebook, 1403 of FIG. 14, generated during encoding.

At the beginning of every frame, a new pitch sequence value is read from 103 of FIG. 1. The pitch sequence value is input to excitation signal synthesizer 2406. The excitation signal synthesizer generates a frame_length excitation segment every frame. In one embodiment of the excitation signal synthesizer, the excitation segment is a pulse-train with pitch equal to the pitch sequence value. In another embodiment of the excitation signal synthesizer, the excitation segment is a multi-pulse signal of the appropriate pitch. In another embodiment of the excitation signal synthesizer, a sum of generally equal amplitude, harmonically related sinusoids with randomized initial phase is used instead of a pulse-train or multi-pulse signal. This gives a richer less "buzzy" sound to the excitation signal. The sum of sinusoids signal can be stored in a time-domain table and pitch shifted using the multirate polyphase FIR filtering approach described in FIG. 22 for simple sinusoids. The time-domain table can be generated by filling a single pitch period table with random samples from the output of a white noise generator. In still another embodiment of the excitation signal synthesizer, the excitation signal is synthesized from an excitation waveform codebook, and excitation codebook sequence much like the embodiment of the residual tonal signal synthesizer of FIG. 23.

In still another embodiment of the excitation signal synthesizer, the original excitation signal, generated during encoding, is used. As previously discussed, one object of the present invention is to reduce the number of parameters sent to the mass storage or communications device, 103 of FIG. 1. Normally this precludes simply sending complete waveforms. However, since the excitation signal has very low variance, each sample can be quantized with very few bits. This represents a substantial reduction in parameter size, and allows the complete excitation signal to be sent.

At the beginning of every frame, a new excitation amplitude sequence value is read from 103 of FIG. 1. The frame_length excitation signal is multiplied, 2407, by the excitation amplitude sequence value. This value is stored in the gain register 2404.

The excitation signal is input to the all-pole filter, 2408, where it is filtered using the LPC coefficients selected from the LPC codebook, 2405, for the current frame. In another embodiment of the LPC residual tonal signal synthesizer, the LPC codebook may be replaced by an AR or ARMA coefficient codebook. In the case of an ARMA coefficient codebook the all-pole filter, 2408, becomes a pole-zero filter. The all-pole LPC and pole-zero ARMA coefficient codebooks and codebook sequences are techniques for representing the time-varying magnitude spectrum of the residual signal. Any magnitude spectrum representation technique, together with spectral shaping of the excitation signal can be effective for the present invention.

The embodiment of FIG. 24 uses an overlap-add approach on output, identical that of FIG. 20 and FIG. 23. The overlap-add implicitly interpolates the magnitude spectra of the excitation segment, the LPC filter coefficients, the excitation amplitude sequence value, and the pitch sequence value. In another embodiment of the LPC residual tonal signal synthesizer, no overlap-add is used. Instead, the LPC filter coefficients excitation amplitude sequence value are explicitly interpolated over the frame, in a manner similar to that used to interpolate amplitude in FIG. 21 and FIG. 22.

Some of the embodiments of encoders and synthesizers described above utilize pitch as a basis for encoding and synthesizing tonal audio signals. In other words, the assumption for embodiments is that the sinusoids have a harmonic relationship. However, the embodiments that do not use pitch are suitable for encoding and synthesizing tonal but non-pitched sounds such as gongs and cymbals. In addition, the non-pitched techniques can be used to encode and synthesize quasi-harmonic sounds such a piano tones that have stretched or detuned harmonics.

Any of the encoder and synthesizer embodiments described above can be used in conjunction with techniques for encoding non-tonal audio signals such as LPC with white noise excitation signal. These combinations can be effectively used to encode and synthesize speech and music signals that have both tonal and colored noise components.

Many of the encoder and synthesizer embodiments described above refer to the magnitude spectrum of either the tonal audio signal or the residual tonal signal. It is obvious to one skilled in the art of digital signal processing that in many cases the magnitude squared spectrum, or a derivation thereof, for example, the autocorrelation function, the log spectrum, the cepstrum, can be used in place of the magnitude spectrum without changing the character of the present invention. This is true, for example, for pitch encoding, for measuring distances between spectra in vector quantization, for smoothing spectra, and for storing and transmitting spectrum sequences. When generating sinusoidal amplitudes or magnitude spectra to be inverse transformed to form time-domain waveforms, these alternative spectrum representations can be reconverted to a standard magnitude spectrum representation.

I claim:

1. A method of encoding a tonal audio signal comprising:

encoding time-varying frequencies and amplitudes of at least one dominant sinusoid component of said tonal audio signal to form a dominant sinusoid parameter sequence;

removing said at least one dominant sinusoid component from said tonal audio signal to form a residual tonal signal;

generating a residual tonal signal vector quantization codebook comprising residual tonal signal coding vectors, wherein each said residual tonal signal coding vector is associated with a unique coding vector number, and wherein said residual tonal signal vector quantization codebook is based on said residual tonal signal;

encoding said residual tonal signal as a sequence of said unique coding vector numbers to form a residual tonal signal codebook sequence.

2. The method according to claim 1, wherein said encoding of time-varying frequencies and amplitudes includes segmenting said tonal audio signal into consecutive frames, and for each said frame performing the steps of:

calculating the magnitude spectrum;

finding the largest maxima of said magnitude spectrum, wherein the number of said largest maxima corresponds to the number of said dominant sinusoid components; and setting said time-varying frequencies and amplitudes for said frame equal to the frequencies and magnitudes of said maxima of said magnitude spectrum.

3. The method according to claim 1, wherein said encoding of time-varying frequencies and amplitudes includes segmenting said tonal audio signal into consecutive frames, and for each said frame performing the steps of:

estimating the fundamental frequency;

calculating magnitude spectrum values at selected harmonic frequencies corresponding to a subset of integer multiples of said fundamental frequency, wherein the number of said harmonic frequencies corresponds to the number of said dominant sinusoid components;

setting said time-varying frequencies and amplitudes for said frame equal to said selected harmonic frequencies and corresponding magnitude spectrum values.

4. The method according to claim 3 wherein said calculating of fundamental frequency includes dividing said fundamental frequency by a small integer number, whereby said harmonic frequencies include subharmonics of said fundamental frequency.

5. The method according to claim 1 wherein said encoding of time-varying frequencies and amplitudes includes segmenting said tonal audio signal into consecutive frames, and for each said frame performing the steps of:

modeling the tonal audio signal waveform segment corresponding to said frame as the impulse response of a digital filter;

finding complex poles of said digital filter;

finding phase angles of said complex poles;

converting said phase angles to pole frequencies;

calculating magnitude spectrum of said impulse response;

finding pole magnitudes corresponding to values of said magnitude spectrum at said pole frequencies;

setting said time-varying frequencies and amplitudes for said frame equal to a subset of said pole frequencies and pole magnitudes, wherein the number of frequencies and magnitudes in said subset corresponds to the number of said dominant sinusoid components.

6. The method according to claim 1 further comprising encoding time-varying phases of said at least one dominant sinusoid component and including said phases in said dominant sinusoid parameter sequence.

7. The method according to claim 6 wherein said removing of said at at least one dominant sinusoid component includes:

resynthesizing said at least one dominant sinusoid component from said dominant sinusoid parameter sequence ; and subtracting said at least one resynthesized dominant sinusoid component from said tonal audio signal to from said residual tonal signal.

8. The method according to claim 1 wherein said removing of said at least one dominant sinusoid component includes:

segmenting said tonal audio tonal audio signal into consecutive frames, and for each said frame performing the steps of (a) calculating frequency spectrum of said frame, (b) generating the zero spectrum of each said frame, wherein said zero spectrum corresponds to the magnitude spectrum of a filter impulse response having zeros at frequencies corresponding to the frequencies of said at least one dominant sinusoid component, (c) generating a filtered frequency spectrum by multiplying said frequency spectrum by said zero spectrum, (d) generating a residual tonal signal waveform segment by inverse transforming said filtered frequency spectrum; and assembling all said residual tonal signal waveform segments in consecutive fashion to form said residual tonal signal.

9. The method according to claim 1 wherein said removing of said at least one dominant sinusoid component includes:

segmenting said tonal audio signal into consecutive frames, and for each said frame performing the steps of (a) generating the impulse response of a filter with zeros at frequencies corresponding to the frequencies of said at least one dominant sinusoid for said frame, and (b) filtering the tonal audio signal waveform segment corresponding to said frame with said impulse response to form a residual tonal signal waveform segment; and assembling all said residual tonal signal waveform segments in consecutive fashion to form said residual tonal signal.

10. The method according to claim 1 wherein said removing of said at least one dominant sinusoid component includes highpass filtering said tonal audio signal to form said residual tonal signal.

11. The method according to claim 1 wherein:

said generating of a residual tonal signal vector quantization codebook includes generating a residual tonal signal waveform codebook based on said residual tonal signal, wherein each waveform in said residual tonal signal waveform codebook is associated with a unique waveform number; and said encoding of said residual tonal signal includes encoding said residual tonal signal as a sequence of said unique waveform numbers to form a residual tonal signal codebook sequence.

12. The method of claim 11 wherein said generating of a residual tonal signal waveform codebook includes:

segmenting said residual tonal signal into consecutive frames;

calculating the magnitude spectrum of each said frame;

assembling all said magnitude spectra in consecutive fashion to form a magnitude spectrum sequence;

vector quantizing said magnitude spectrum sequence to form a magnitude spectrum codebook, and, for each magnitude spectrum in said magnitude spectrum codebook, performing the steps of (a) finding the single magnitude spectrum in said magnitude spectrum sequence that is closest to said codebook magnitude spectrum according to a spectral distance measure, and (b) finding the residual tonal signal waveform segment associated with said single magnitude spectrum; and assembling all said residual tonal signal waveform segments to form said residual tonal signal waveform codebook.

13. The method according to claim 12 wherein:

each magnitude spectrum in said magnitude spectrum sequence and each magnitude spectrum in said magnitude spectrum codebook is associated with a fundamental frequency; and said spectral distance measure includes a pitch penalty term, wherein increasing differences between fundamental frequencies associated with two magnitude spectra correspond to increasing spectral distances.

14. The method according to claim 11 wherein all waveforms in said residual tonal signal waveform codebook are of the same length.

15. The method of claim 11 wherein said generating of a residual tonal signal waveform codebook includes:

segmenting said residual tonal signal into consecutive frames, and for each said frame performing the steps of (a) estimating the fundamental frequency, (b) calculating magnitude spectrum values at harmonic frequencies corresponding to integer multiples of said fundamental frequency up to a predetermined high-frequency cutoff, wherein said magnitude spectrum values form a harmonic spectrum, and (c) setting said harmonic spectrum values to zero at harmonic frequencies corresponding to the frequencies of said dominant sinusoid components;

assembling all said harmonic spectra in consecutive fashion to form a harmonic spectrum sequence;

vector quantizing said harmonic spectrum sequence to form a harmonic spectrum codebook;

assigning phase values to all harmonic spectrum values in said harmonic spectrum codebook to form a complex harmonic spectrum codebook; and inverse transforming each said complex harmonic spectrum in said complex harmonic spectrum codebook to form said residual tonal signal waveform codebook.

16. The method according to claim 15 wherein all harmonic spectra in said harmonic spectrum codebook have the same length, and wherein said assigning phase values includes the steps of:

generating a vector of random phase values, wherein the number of phase values in said vector is equal to the length of each said harmonic spectrum in said harmonic spectrum codebook; and assigning said vector of random phase values to each said harmonic spectrum in said harmonic spectrum codebook.

17. The method of claim 11 further comprising the steps of:

generating a magnitude spectrum codebook by calculating the magnitude spectrum of each waveform in said residual tonal signal waveform codebook;

generating an inverse filter codebook by substantially inverting each magnitude spectrum in said magnitude spectrum codebook;

inverse filtering each waveform in said residual tonal signal waveform codebook using the corresponding inverse filter in said inverse filter codebook.

18. An encoder according to claim 17 wherein:

said calculating magnitude spectrum includes calulating coefficients of a pole-zero filter;

said substantially inverting each magnitude spectrum includes inverting said pole-zero filter coefficients;

said inverse filtering includes filtering using said inverted pole-zero filter coefficients.

19. The method according to claim 1 wherein said generating a residual tonal signal vector quantization codebook includes generating a residual tonal signal magnitude spectrum codebook comprising residual tonal signal magnitude spectrum coding vectors, wherein each said residual tonal signal magnitude spectrum coding vector is associated with a unique magnitude spectrum coding vector number, and wherein said residual tonal signal magnitude spectrum codebook is based on said residual tonal signal.

20. The method according to claim 19 wherein said residual tonal signal magnitude spectrum coding vectors include pole-zero filter coefficients.

21. The method according to claim 1 further including:

normalizing said residual tonal signal coding vectors;

generating a residual tonal signal amplitude sequence wherein an amplitude value is associated with each entry in said residual tonal signal codebook sequence.

22. A method for synthesizing a tonal audio signal comprising:

receiving a dominant sinusoid parameter sequence comprising time-varying frequencies and amplitudes, and a residual tonal signal vector quantization codebook made up of residual tonal signal coding vectors, wherein each said residual tonal signal coding vector is associated with a unique coding vector number, and a residual tonal signal codebook sequence comprising a sequence of said unique coding vector numbers from an input device;

synthesizing at least one dominant sinusoid component from said dominant sinusoid parameter sequence;

synthesizing a residual tonal signal from said residual tonal signal vector quantization codebook, and from said residual tonal signal codebook sequence;

summing said at least one dominant sinusoid component and said residual tonal signal to form said tonal audio signal.

23. The method according to claim 22 wherein each said residual tonal signal coding vector includes a time-domain waveform.

24. The method according to claim 23 wherein the frequency dependent phase response of the Fourier transform of each said time-domain waveform is substantially identical.

25. The method according to claim 23 wherein the waveform length of each said time-domain waveform is identical.

26. The method according to claim 23 further including:

associating a magnitude spectrum with each said time-domain waveform; and filtering each said time-domain waveform by a filter with a frequency response substantially equal to said magnitude spectrum associated with said time-domain waveform.

27. The method according to claim 26 wherein each said magnitude spectrum includes filter coefficients for a pole-zero filter.

28. The method according to claim 22 including adjusting the pitch of said residual tonal signal based on a time-varying pitch sequence.

29. The method according to claim 22 including adjusting the amplitude of said residual tonal signal based on a time-varying residual tonal signal amplitude sequence.

30. The method according to claim 22 including:

including a magnitude spectrum shape with each said residual tonal signal coding vector;

synthesizing a synthetic excitation signal; and generating a time-varying magnitude spectrum sequence by selecting said magnitude spectrum shapes associated with said residual tonal signal coding vectors from said residual tonal signal vector quantization codebook in a consecutive order determined by said residual tonal signal codebook sequence;

shaping the magnitude spectrum of said synthetic excitation signal with said time-varying magnitude spectrum sequence.

31. The method according to claim 30 wherein synthesizing said synthetic excitation signal includes reading out periodically from a single pitch period length sample table formed from randomly generated samples.

32. The method according to claim 30 wherein synthesizing said synthetic excitation signal includes generating a periodic pulse-train.

33. The method according to claim 30 wherein each said magnitude spectrum vector includes coefficients for a poles-zero filter.

34. The method according to claim 30 wherein each said magnitude spectrum vector is interpolated over a frame period from the values of the preceding frame to the values of the current frame, whereby dicontinuities in magnitude spectrum values are avoided.

35. A method for synthesizing a tonal audio signal comprising:

receiving a dominant sinusoid parameter sequence comprising time-varying frequencies and amplitudes, and a time-varying sequence of codebook vector numbers for vector-quantized residual tonal signal magnitude spectra from an input device;

synthesizing at least one dominant sinusoid component from said dominant sinusoid parameter sequence;

synthesizing a periodic excitation signal;

shaping the magnitude spectrum of said excitation signal with said residual tonal signal time-varying sequence of magnitude spectra, to form a residual tonal signal;

summing said at least one dominant sinusoid component and said residual tonal signal to form said tonal audio signal.

36. The method according to claim 35 wherein synthesizing said synthetic excitation signal includes reading out periodically from a single pitch period length sample table formed from randomly generated samples.

37. The method according to claim 35 wherein synthesizing said synthetic excitation signal includes generating a periodic pulse-train.

38. The method according to claim 35 wherein each residual tonal signal magnitude spectrum vector from said residual tonal signal time-varying sequence of magnitude spectra is comprised of coefficients for a time-varying digital filter.

39. The method according to claim 35 wherein each residual tonal signal magnitude spectrum vector from said residual tonal signal time-varying sequence of magnitude spectra is interpolated over a frame period from the values of the preceding frame to the values of the current frame, whereby dicontinuities in magnitude spectrum values are avoided.

40. An apparatus for encoding a tonal audio signal comprising:

a dominant sinusoid encoder for encoding time-varying frequencies and amplitudes of at least one dominant sinusoid component of said tonal audio signal;

a dominant sinusoid remover for removing said at least one dominant sinusoid component from said tonal audio signal to form a residual tonal signal;

a residual tonal signal vector quantization codebook comprising residual tonal signal coding vectors, wherein each said residual tonal signal coding vector is associated with a unique coding vector number, and wherein said residual tonal signal vector quantization codebook is based on said residual tonal signal;

a residual tonal signal encoder for encoding said residual tonal signal as a sequence of said unique coding vector numbers to form a residual tonal signal codebook sequence.

41. The apparatus according to claim 40 wherein:

said residual tonal signal vector quantization codebook includes a residual tonal signal waveform codebook based on said residual tonal signal, wherein each waveform in said residual tonal signal waveform codebook is associated with a unique waveform number; and said codebook sequence includes a sequence of said unique waveform numbers.

42. An apparatus for synthesizing a tonal audio signal comprising:

an input device for receiving a dominant sinusoid parameter sequence comprising time-varying frequencies and amplitudes, and a residual tonal signal vector quantization codebook made up of residual tonal signal coding vectors, wherein each said residual tonal signal coding vector is associated with a unique coding vector number, and a residual tonal signal codebook sequence comprising a sequence of said unique coding vector numbers;

a dominant sinusoid synthesizer for synthesizing at least one dominant sinusoid component from said dominant sinusoid parameter sequence;

a residual tonal signal synthesizer for synthesizing a residual tonal signal from said residual tonal signal vector quantization codebook, and from said residual tonal signal codebook sequence;

an adder for summing said at least one dominant sinusoid component and said residual tonal signal to form said tonal audio signal.

* * * * *